US011473370B2

(12) United States Patent
Chen

(10) Patent No.: US 11,473,370 B2
(45) Date of Patent: Oct. 18, 2022

(54) RESISTANCE DEVICE

(71) Applicant: Nien Made Enterprise Co., Ltd., Taichung (TW)

(72) Inventor: Lin Chen, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 49 days.

(21) Appl. No.: 17/134,214

(22) Filed: Dec. 25, 2020

(65) Prior Publication Data

US 2022/0205316 A1 Jun. 30, 2022

(51) Int. Cl.
*E06B 9/322* (2006.01)

(52) U.S. Cl.
CPC ..... *E06B 9/322* (2013.01); *E06B 2009/3222* (2013.01)

(58) Field of Classification Search
CPC ..... E06B 9/322; E06B 2009/3222
See application file for complete search history.

(56) References Cited

U.S. PATENT DOCUMENTS 3,952,789 A * 4/1976 Marotto ..... E06B 9/324 160/168.1 R
4,039,020 A * 8/1977 Jacobson ..... E06B 9/324 160/178.2
4,180,118 A * 12/1979 Vecchiarelli ..... E06B 9/324 188/65.1
4,722,383 A * 2/1988 Kross ..... E06B 9/324 160/168.1 R
5,263,528 A * 11/1993 Patel ..... E06B 9/324 24/115 L
5,709,258 A * 1/1998 Coccoluto ..... E06B 9/326 16/442
7,117,920 B2 * 10/2006 Dekker ..... E06B 9/324 160/84.04
7,174,943 B2 * 2/2007 Wang ..... E06B 9/262 160/178.2
7,261,138 B2 * 8/2007 Judkins ..... E06B 9/324 160/178.2
7,331,370 B1 2/2008 Militello
7,597,131 B2 * 10/2009 Nien ..... E06B 9/324 160/84.05

(Continued)

FOREIGN PATENT DOCUMENTS

JP 6505140 B2 4/2019
JP 2019-157561 A 9/2019

(Continued)

*Primary Examiner* — Johnnie A. Shablack
(74) *Attorney, Agent, or Firm* — Winston Hsu

(57) ABSTRACT

A resistance device includes a base having a channel, a friction member provided in the base, and a moving member adjacent to the friction member, wherein the moving member is located in the channel and is movable therein. A window covering applied with the resistance device includes a covering material and a lifting cord concurrently movable with the covering material. When the covering material is being retracted or extended, the lifting cord moves in two opposite directions, respectively. The lifting cord passes through the resistance device. When the lifting cord moves in either direction, it drives the moving member to move in the same direction as itself. The friction member provides different resistances to the lifting cord which moves in different directions.

17 Claims, 28 Drawing Sheets

(56) References Cited

U.S. PATENT DOCUMENTS

| | | | | |
|---|---|---|---|---|
| 8,156,991 | B2 * | 4/2012 | Cheng | E06B 9/324 160/173 R |
| 9,435,153 | B2 * | 9/2016 | Chen | E06B 9/322 |
| 10,119,329 | B2 * | 11/2018 | Anderson | E06B 9/304 |
| 10,563,455 | B2 * | 2/2020 | Chen | E06B 9/324 |
| 10,704,323 | B2 * | 7/2020 | Chen | E06B 9/322 |
| 10,704,658 | B2 * | 7/2020 | Chen | F16H 19/0672 |
| 10,995,545 | B2 * | 5/2021 | Chen | E06B 9/364 |
| 11,047,172 | B2 * | 6/2021 | Huang | E06B 9/322 |
| 11,230,881 | B2 * | 1/2022 | Chen | E06B 9/322 |
| 11,286,714 | B2 * | 3/2022 | Lei | E06B 9/322 |
| 2002/0033241 | A1 | 3/2002 | Palmer | |
| 2003/0173037 | A1 * | 9/2003 | Liu | E06B 9/324 160/178.2 |
| 2008/0099157 | A1 * | 5/2008 | Nien | E06B 9/322 160/84.05 |
| 2008/0099162 | A1 * | 5/2008 | Ayers | E06B 9/324 160/178.2 |
| 2010/0089539 | A1 * | 4/2010 | Stone | E06B 9/324 160/178.2 |
| 2010/0206492 | A1 * | 8/2010 | Shevick | E06B 9/30 160/170 |
| 2011/0290429 | A1 * | 12/2011 | Cheng | E06B 9/322 160/84.02 |
| 2013/0032300 | A1 * | 2/2013 | Yu | E06B 9/322 160/84.02 |
| 2015/0275572 | A1 | 10/2015 | Huang | |
| 2016/0298385 | A1 * | 10/2016 | Chen | E06B 9/322 |
| 2016/0376839 | A1 * | 12/2016 | Huang | E06B 9/323 160/368.1 |
| 2017/0298688 | A1 * | 10/2017 | Chen | F03G 1/00 |
| 2019/0063147 | A1 * | 2/2019 | Cheng | B65H 75/486 |
| 2019/0162278 | A1 | 5/2019 | Chen | |
| 2019/0301238 | A1 * | 10/2019 | Chang | E06B 9/322 |
| 2019/0323291 | A1 | 10/2019 | Chen | |
| 2020/0040655 | A1 * | 2/2020 | Chen | B65H 75/446 |

FOREIGN PATENT DOCUMENTS

| | | | |
|---|---|---|---|
| JP | 6763689 | B2 | 9/2020 |
| WO | 2013/019283 | A1 | 2/2013 |

* cited by examiner

RESISTANCE DEVICE

BACKGROUND OF THE DISCLOSURE

1. Field of the Disclosure

The present invention relates generally to a resistance device, and more particularly to a kind capable of providing resistance to the lifting cords of a window covering.

2. Description of the Prior Art

Generally, a cordless window covering includes a headrail, a covering material, a bottom rail, and a lifting mechanism used to extend or retract (i.e., open or close) the covering material. A lifting mechanism usually includes a lifting cord and a driving unit, and the driving unit is commonly a spring box located in the headrail. Such a spring box includes a reeling wheel, a driving wheel, a spring wheel, and a spring connecting the driving wheel and the spring wheel. The reeling wheel and the driving wheel mesh with each other, and therefore are linked to move concurrently. The lifting cord passes through the covering material, with an end thereof connected to the reeling wheel and another end thereof connected to the bottom rail. When the bottom rail is pulled to expand the covering material, the lifting cord is released from the reeling wheel, which drives the reeling wheel to rotate. As the reeling wheel rotates, the driving wheel is driven to rotate at the same time, whereby the spring winds around the driving wheel to accumulate a rewinding force. When the bottom rail is pushed to retract the covering material, raising the covering material, the rewinding force drives the driving wheel to rotate in an opposite direction, which also drives the reeling wheel to rotate in an opposite direction. Consequently, the reeling wheel reels in the lifting cord.

When the force applied onto the bottom rail is removed, there should come to a balance between the rewinding force of the spring, the friction of the mechanisms in the window covering, and the weight of the covering material, so that the bottom rail can stay at any required position. However, since the rewinding force, the friction, and the downward pulling force mentioned above are all not constant but subject to change during the process of lifting and lowering, their magnitudes can only be roughly estimated. Therefore, the lifting mechanism mentioned above tends to have problems of keeping the balance between the three forces, which causes the bottom rail to move upward or fall downward gradually. Moreover, it would not be easy to pull or push the bottom rail during its operation. Specifically, along with the process of expanding the covering material, there will be fewer and fewer slats stacked on the bottom rail. Therefore the downward pulling force caused by gravity will decrease. If the spring provides an excessive winding force, instead of staying at the required position, the bottom rail will gradually move upward once the external force which pulls the bottom rail downward is removed. An intuitional way to solve this kind of problem is to reduce the magnitude of the winding force. Unfortunately, with a weaker winding force, the window covering will encounter an opposite problem. When the covering material is being raised, the gravity's downward pulling force will increase as there are more and more slats stacked on the bottom rail. Once the upward external pushing force is removed, the winding force of the spring will be insufficient to maintain the location of the bottom rail. Therefore the bottom rail will gradually fall and leave the required position.

For the above reasons, how to improve the overall balance of a window covering, make the bottom rail stay at where it is demanded, and even facilitate the smoothness of operation, has become a problem we are eager to resolve.

SUMMARY OF THE DISCLOSURE

One aspect of the present invention is to provide a resistance device for window coverings to solve the balancing problem which a cordless window covering may encounter during its lifting and lowering.

The present invention provides a resistance device for a window covering, which includes a covering material and a lifting mechanism, wherein the lifting mechanism includes a lifting cord, and the lifting cord is linked to the covering material in a manner that the lifting cord is concurrently movable with the covering material. When the covering material is being retracted (i.e., raised), the lifting cord moves in a first direction; when the covering material is being extended (i.e., lowered), the lifting cord moves in a second direction opposite to the first direction. The resistance device includes a base, a friction member, and a moving member. The base has a channel therein. The friction member is provided in the base. The moving member is adjacent to the friction member. The moving member is located in the channel and is movable therein. The resistance device is adapted to allow the lifting cord to pass through. The moving member is adapted to be driven by the lifting cord to move in same directions as the lifting cord. When the moving member moves inside the channel in the first direction as driven by the lifting cord, the friction member provides a first resistance to the lifting cord. When the moving member moves inside the channel in the second direction as driven by the lifting cord, the friction member provides a second resistance to the lifting cord. The first resistance is different from the second resistance.

Based on the above description, the resistance device of the present invention has the following advantages:

1. The friction member of the resistance device could provide different resistances when the lifting cord of the window covering is moved in different directions, which would satisfy the requirement for maintaining the overall balance of the window covering; and 2. The resistance device has the adjusting member to adjust the prestress, which is provided to the lifting cord of the window covering by the friction member, so the resistance device could be applied to window coverings of various sizes and kinds.

The resistance device of the present invention could improve the problem regarding the overall balance of a cordless window covering while also making the lifting and lowering operations smooth. Furthermore, the covering material and the bottom rail could be maintained at any required locations.

These and other objectives of the present disclosure will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which

FIG. 3B is a perspective view of the resistance device of FIG. 3A, with the base thereof shown see-through;

FIG. 4 is a perspective view of the resistance device of FIG. 3B seen in another angle, which is also rendered see-through;

FIG. 9B is a perspective view of the resistance device of FIG. 9A, with the base thereof shown see-through;

FIG. 10B is a perspective view of the resistance device of FIG. 10A, with the base thereof shown see-through;

FIG. 18B is a perspective view of the resistance device of FIG. 18A, with the base thereof shown see-through;

DETAILED DESCRIPTION

Figure 1:
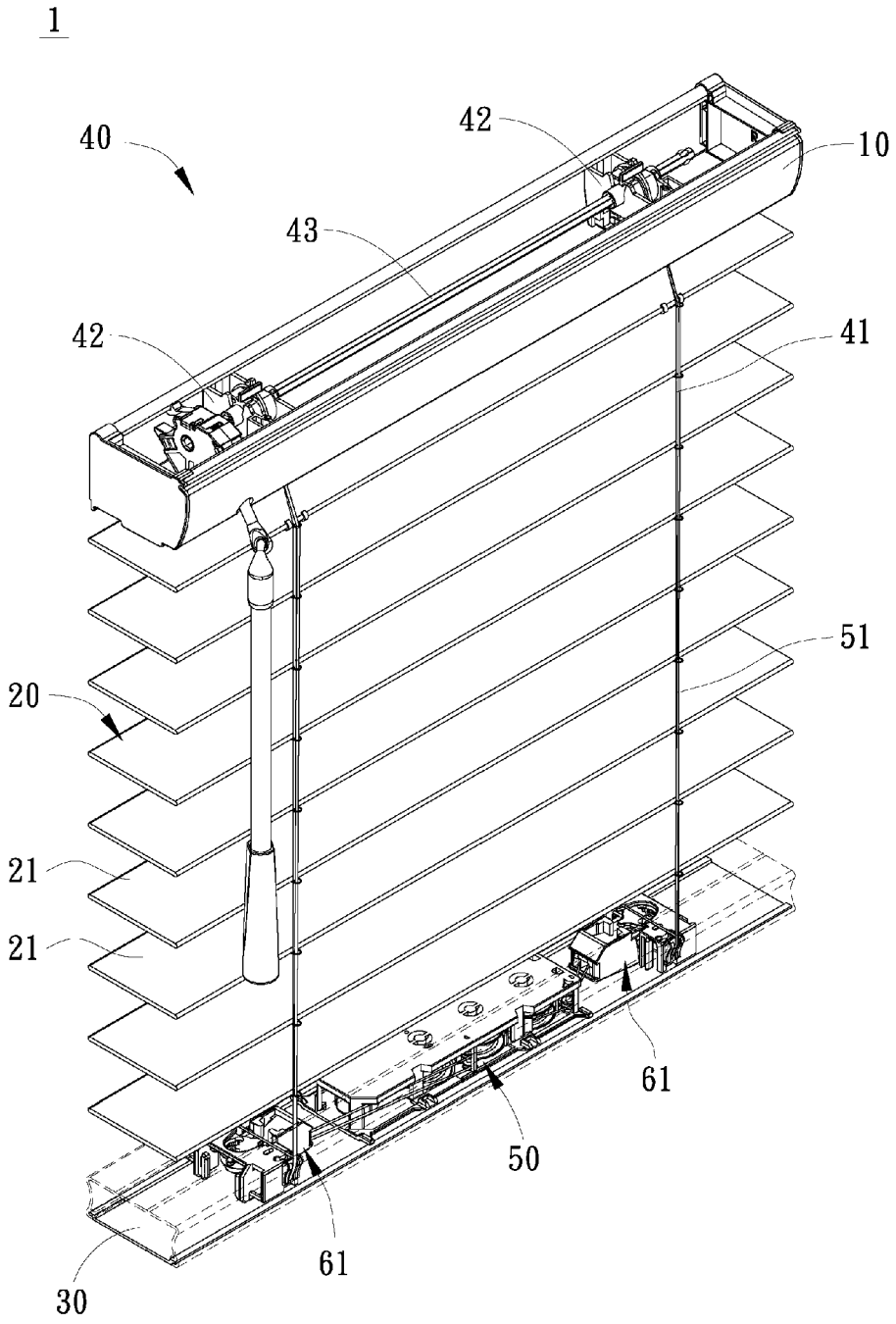
FIG. 1 is a perspective view of a window blind applied with the resistance device of the present invention.
Figure 2:
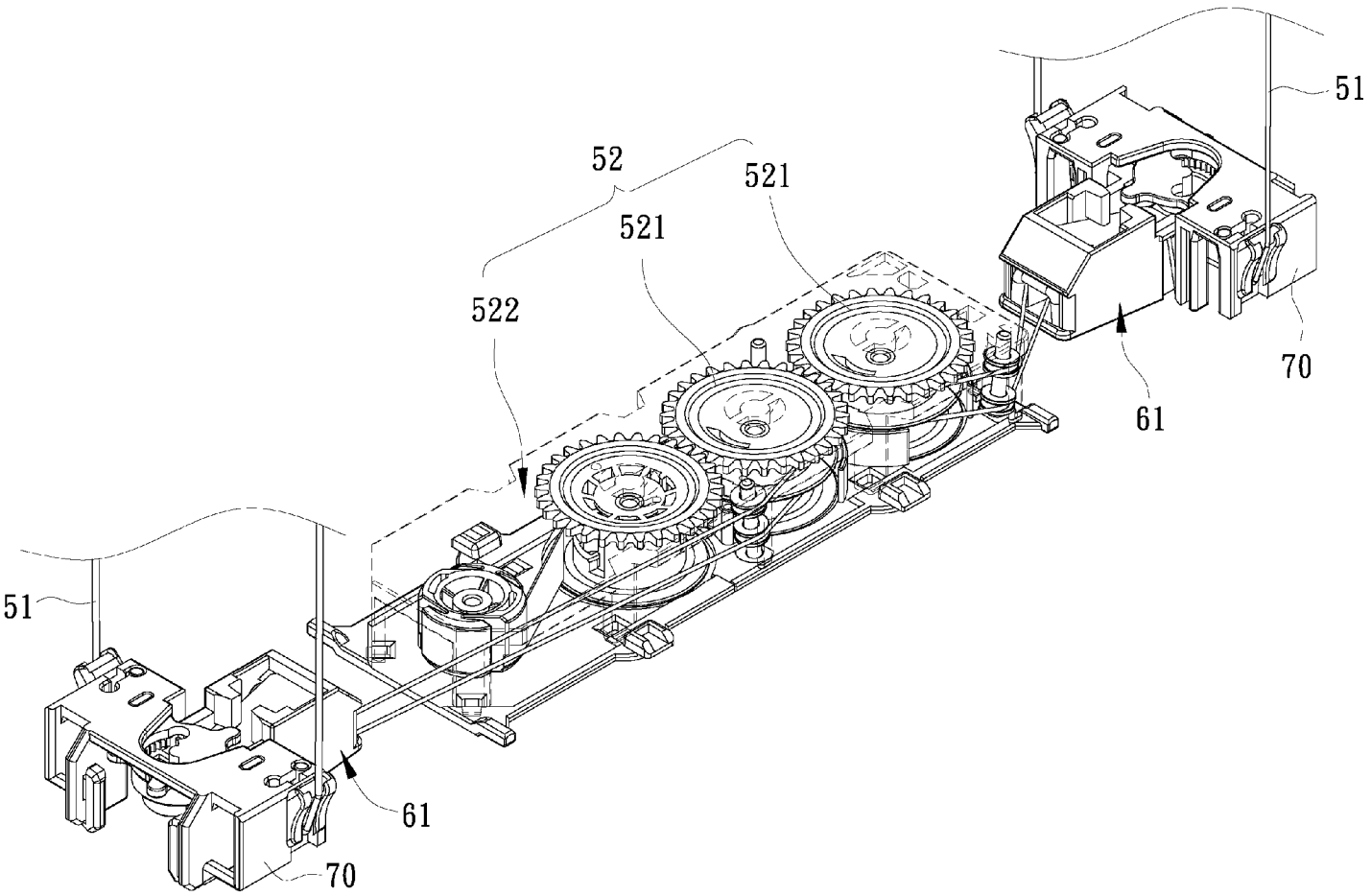
FIG. 2 is a perspective view of the lifting mechanism and the resistance device located in the bottom rail.

A window covering 1 applied with two resistance devices of the present invention is shown in FIG. 1 and FIG. 2. The window covering 1, as shown in FIG. 1, includes a headrail 10, a covering material 20, a bottom rail 30, a modulation mechanism 40, a lifting mechanism 50, and two resistance devices 61. The headrail 10 is a hollow casing extending horizontally. The covering material 20 is located below the headrail 10. In the current embodiment, the covering material 20 includes a plurality of covering members 21, which are also extending horizontally; however, how the covering material 20 is implemented is not a limitation of the present invention. The bottom rail 30 is also a hollow casing extending horizontally and is located below the bottommost covering member 21. The modulation mechanism 40 is provided at the headrail 10, and includes two ladder cords 41, two modulation drums 42, and a modulation shaft 43 which is extending horizontally and passing through the modulation drums 42. When the modulation shaft 43 is driven to rotate, it would drive the ladder cords 41 connected to the modulation drum 42 to make vertical relative movements. In this way, the tilt angle of the covering members 21 could be changed, whereby the amount of light allowed to pass through the covering material 20 could be adjusted. The modulation mechanism 40 is conventional techniques in its whole, and therefore we are not going to describe further details about its arrangements and how it works. In addition, the modulation mechanism 40 can be driven manually or electrically in practice; the function and effect of the resistance devices of the present invention would work the same in either scenario.

The lifting mechanism 50 is provided at the bottom rail 30, and includes two lifting cords 51 and an actuating unit 52. The actuating unit 52 includes two reeling wheels 521 and an elastic winding unit 522, wherein the elastic winding unit 522 is linked to the reeling wheels 521 in a manner that they can be moved concurrently by each other, as shown in FIG. 2. Each of the lifting cords 51 is connected to and wound around one of the reeling wheels 521, respectively. After coming out from the actuating unit 52 and passing through the covering material 20, the lifting cords 51 are connected to the mechanisms in the headrail 10. When the bottom rail 30 is being pushed upward to retract (i.e., raise) the covering material 20, the lifting cords 51 are being rewound around the reeling wheels 521 by the rewinding force provided by the elastic winding unit 522. Herein we define a moving direction of each of the lifting cords 51 at this time (i.e., the direction of being retracted to its corresponding reeling wheel 521) is a first direction D1. When the bottom rail 30 is being pulled down to extend (i.e., lower) the covering material 20, the lifting cords 51 are being released from the reeling wheels 521 due to the downward pulling force which overcomes the rewinding force of the elastic winding unit 522. Herein we define a moving direction of each of the lifting cords 51 at this time, i.e., the direction of being released from its corresponding reeling wheel 521, is a second direction D2, wherein the second direction D2 is opposite to the first direction D1 mentioned above. With such design, the operation of the lifting mechanism 50 could match the descending and ascending of the covering material 20 to change the size of an area covered by the covering material 20.

The resistance devices 61 are provided on sides of the actuating unit 52. On each side, one of the lifting cords 51 extends out from the actuating unit 52 and then passes through the corresponding resistance device 61, whereby the resistance devices 61 provide resistance to the lifting cords 51. As mentioned above, there are two resistance devices 61 respectively provided on two sides of the actuating unit 52 in the current embodiment; furthermore, said two resistance devices 61 are arranged in reflection symmetric with respect to the actuating unit 52. A fixing seat 70 is further provided on each side to fix the corresponding resistance device 61 to the bottom rail 30. In FIG. 1, the modulation mechanism 40 is provided at the headrail 10, while the lifting mechanism. 50 and the resistance devices 61 are provided at the bottom rail 30; however, these arrangements are merely one way of implementation. In other embodiments, the lifting mechanism 50 or the resistance devices 61 can also be provided at the headrail 10. The positions of these components would not affect the functions and effects of the resistance device provided in the present invention.

Figure 3A:
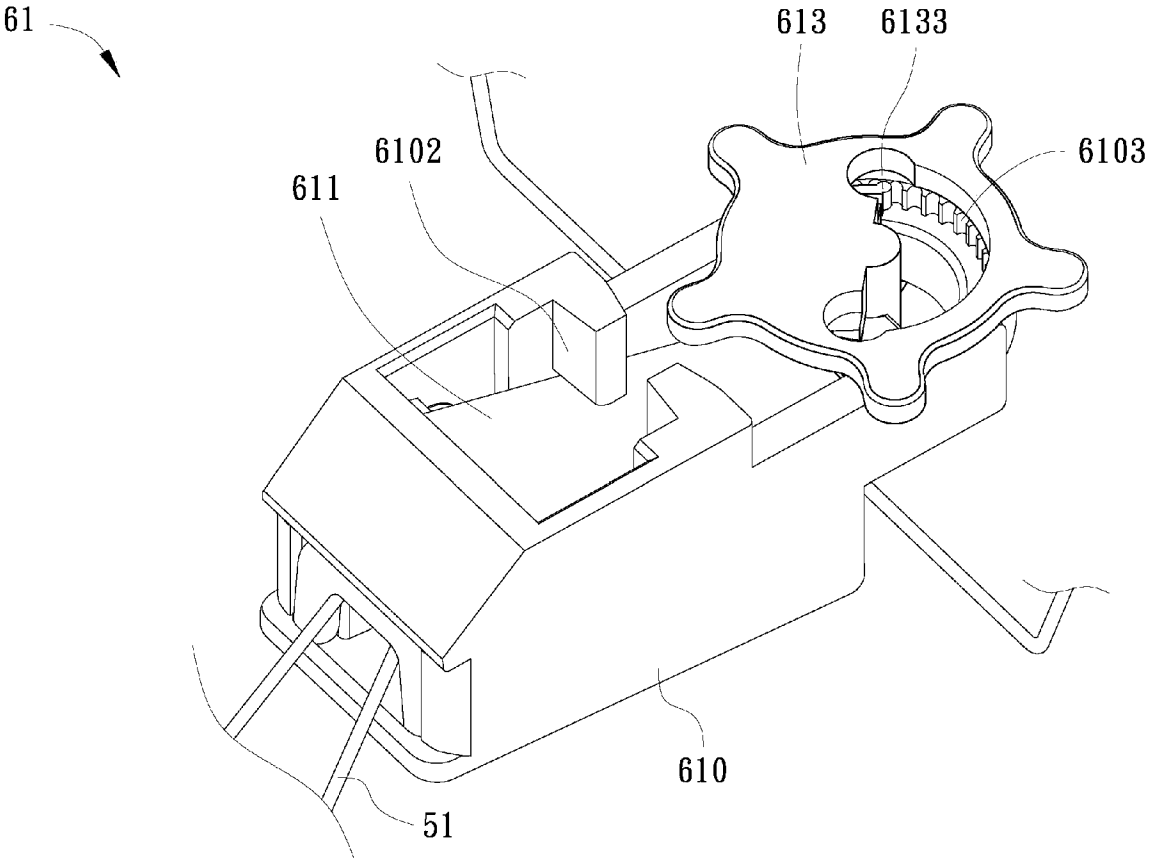
FIG. 3A is a perspective view of a first embodiment of the resistance device of the present invention.
Figure 3B:
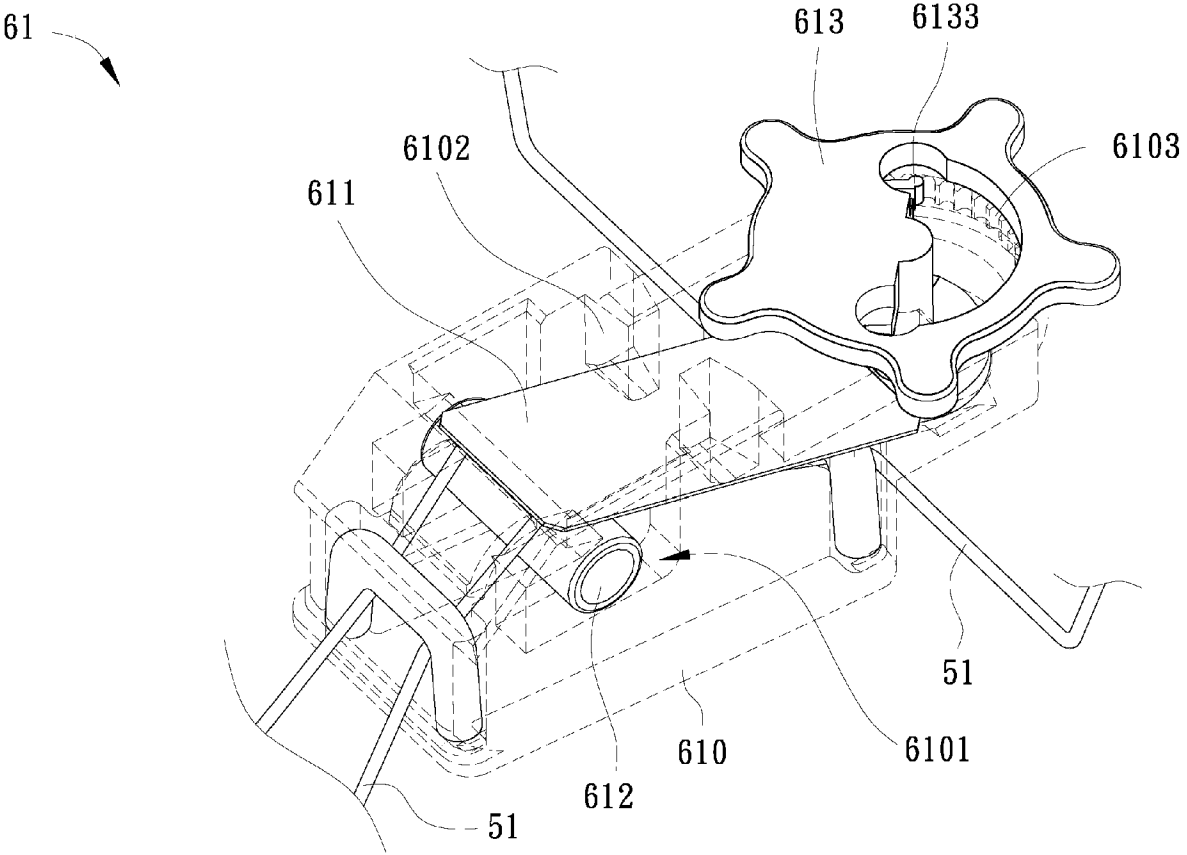
Figure 4:
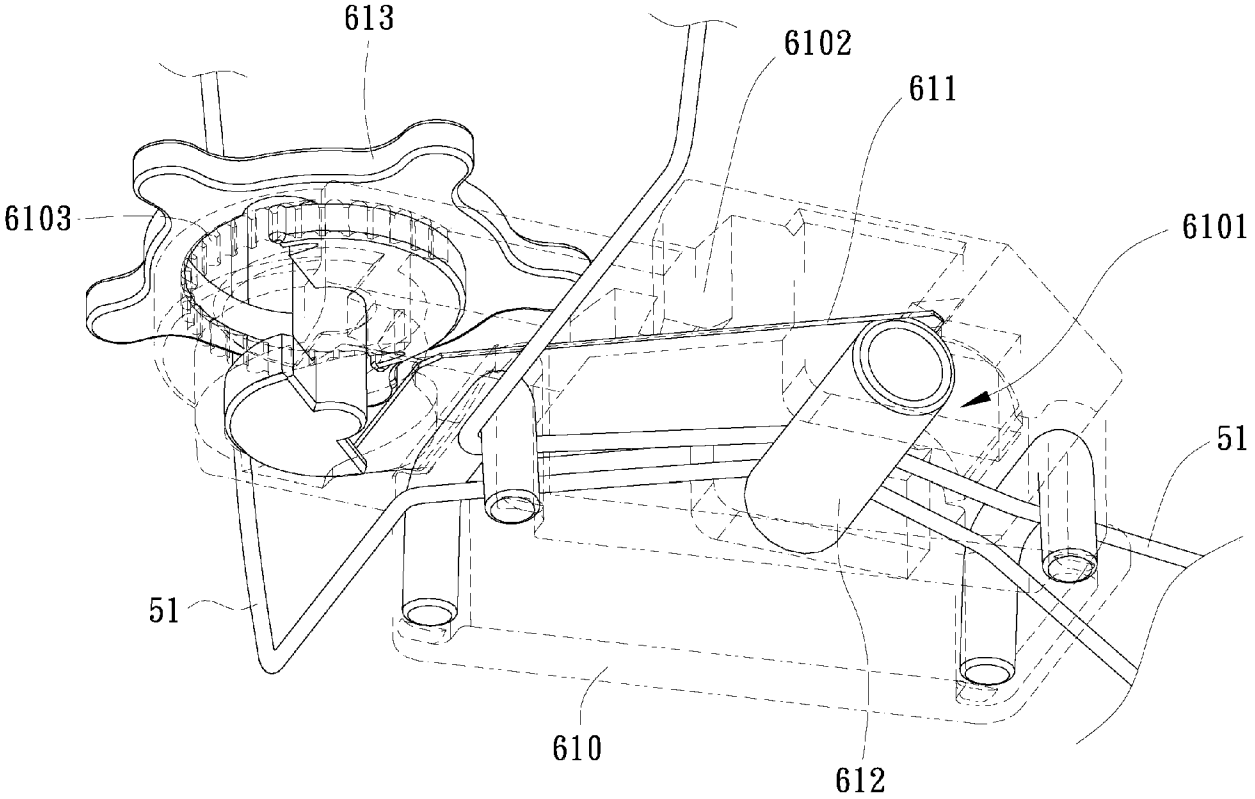
Figure 5:
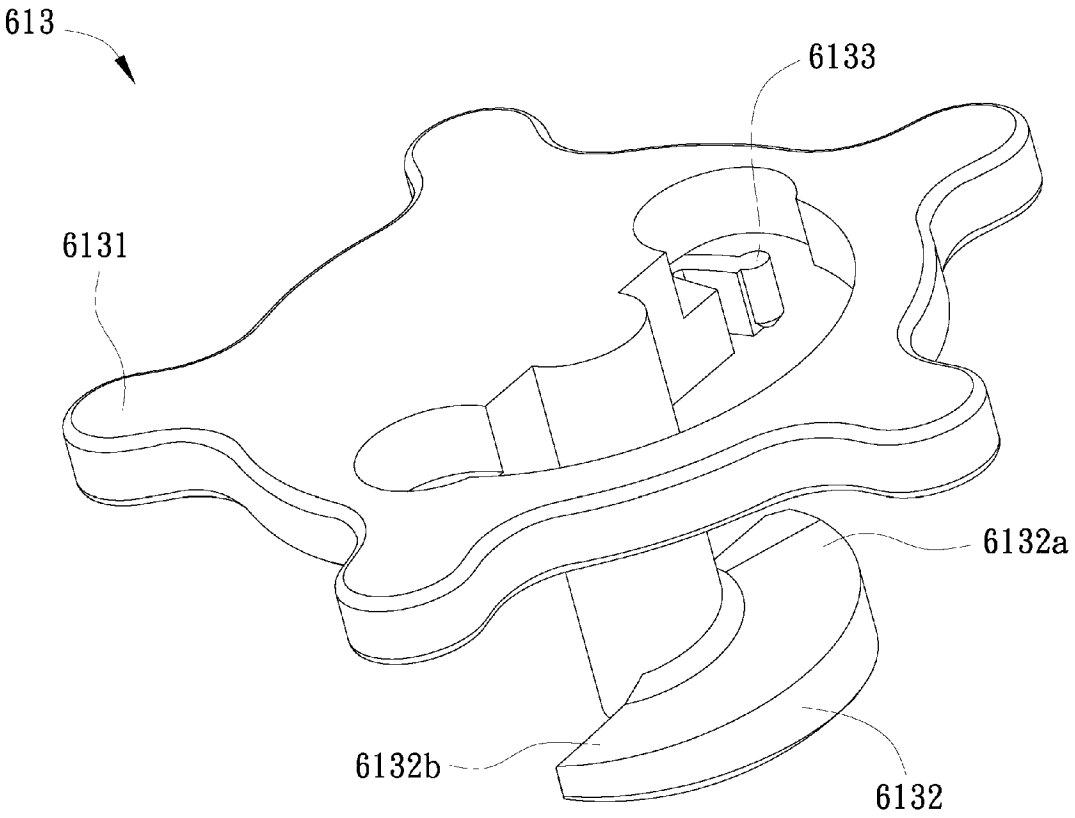
FIG. 5 is a perspective view of the adjusting member of the resistance device of FIG. 3B.
Figure 6:
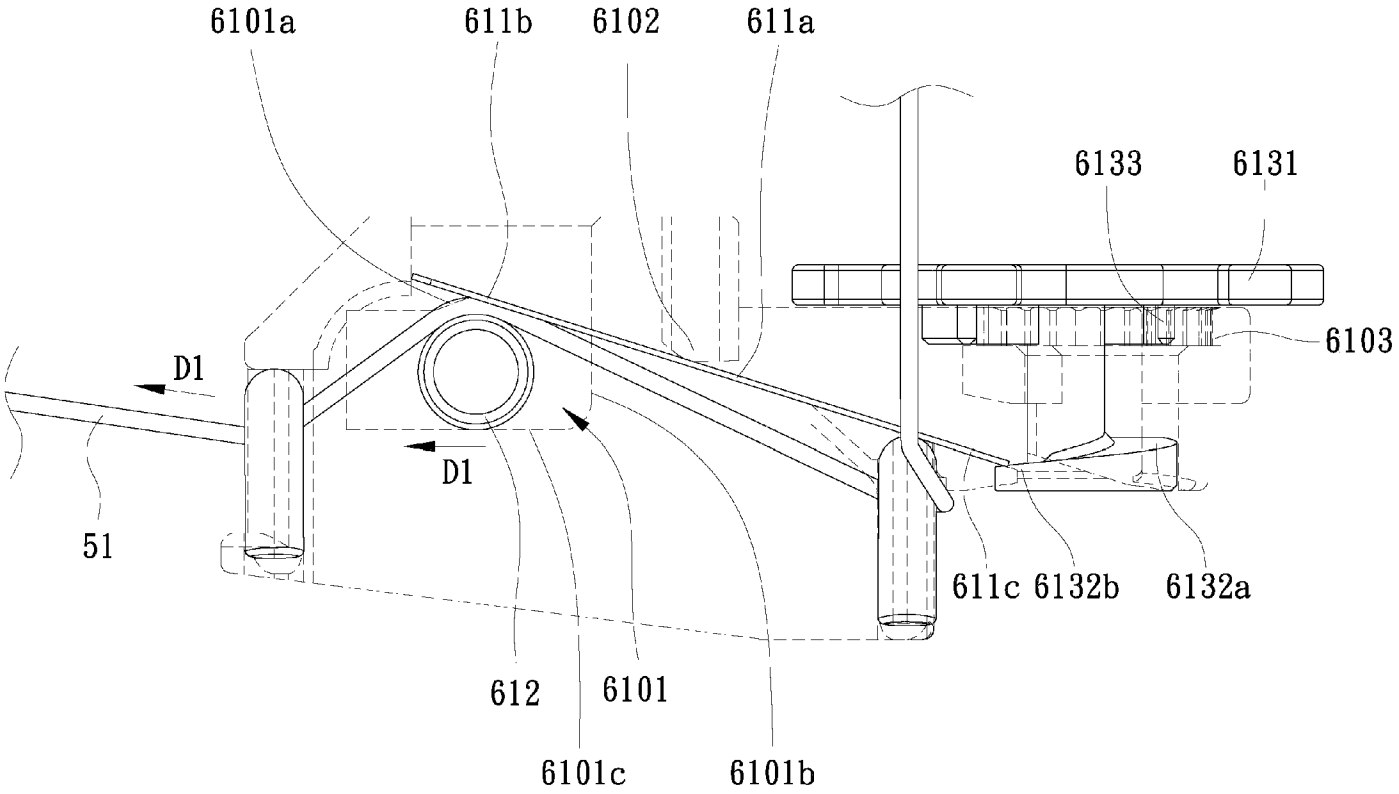
FIG. 6 is a schematic view showing the condition of the resistance device of the first embodiment when the lifting cord is moved in the first direction.

Take the resistance device 61 on the right side of the actuating unit 52 shown in FIG. 2 as an example; herein, we are going to describe the detailed structure of the resistance device of a first embodiment of the present invention. As shown in FIG. 3A to FIG. 8, the resistance device 61 includes a base 610. Inside the base 610, a friction member 611, a moving member 612, and an adjusting member 613 are provided, as illustrated in FIG. 3B and FIG. 4. In these figures, the base 610 is shown "see-through" and is drawn with dotted lines, so that the arrangement of the components in the base 610 can be revealed. The base 610 has a channel 6101, which allows the moving member 612 to slide therein, a support 6102 for supporting the friction member 611, and a first engaging portion 6103 for fixing a position of the adjusting member 613. In the current embodiment, the channel 6101 is a passage with continuous walls, and is composed of a first restriction portion 6101*a*, a second restriction portion 6101*b*, and a supporting portion 6101*c*. The moving member 612 is a cylinder, and is adapted to be moved back and forth in the channel 6101 along the supporting portion 6101*c*. Understandably, though the supporting portion 6101*c* has a continuous wall, this is not a limitation of the present invention. In other embodiments, the supporting portion 6101*c* can also be composed of multiple ribs or supports arranged at intervals, as long as the moving member 612 can be supported to make back-and-forth movements. The friction member 611 is a spring sheet, which has a main portion 611*a*, a first free end 611*b* extending outward from a side of the main portion 611*a*, and a second free end 611*c* extending outward from another side of the main portion 611*a*, as shown in FIG. 6. The friction member 611 is provided on a side of the moving member 612, with its first free end 611*b* adjacent to the moving member 612. The main portion 611*a* of the friction member 611 abuts against (and therefore gets supported by) the support 6102 of the base 610. As for the second free end 611*c*, it is provided corresponding to the adjusting member 613. The adjusting member 613 is provided on the base 610 in a manner that the adjusting member 613 is rotatable relative to the base 610. Furthermore, as shown in FIG. 5, the adjusting member 613 has an operating end 6131, an actuating end 6132, and a second engaging portion 6133 for fixing a position of the adjusting member 613. The operating end 6131 is a rotating disc exposed out of the base 610, and the second engaging portion 6133 is an elastic protrusion. The first engaging portion 6103 of the base 610 is a toothed ring with inner teeth, and has multiple recesses, which can be optionally engaged with the elastic and protruding second engaging portion 6133. The actuating end 6132 is a slope extending from a high point 6132*a* downward to a low point 6132*b*. In the current embodiment, the reeling wheel 521 is located on a left side of the resistance device 61, so that the lifting cord 51 released from the reeling wheel 521 enters the resistance device 61 from the left side of the resistance device 61. Before leaving the resistance device 61, the lifting cord 51 passes through a space between the friction member 611 and the moving member 612. A segment of the lifting cord 51 which passes through the friction member 611 and the moving member 612 is clamped by the friction member 611 and the moving member 612.

Figure 7:
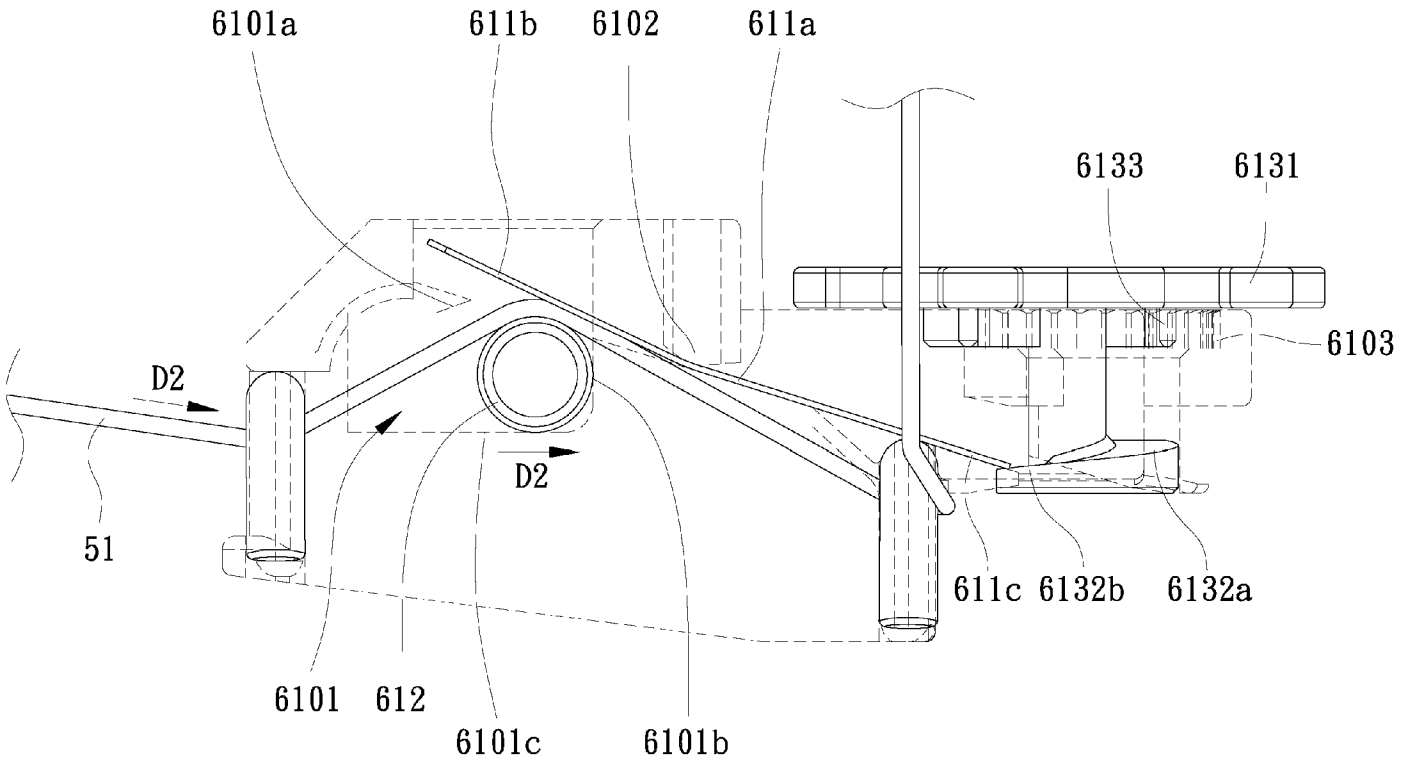
FIG. 7 is a schematic view showing the condition of the resistance device of the first embodiment when the lifting cord is moved in the second direction.

Herein we are going to explain how the resistance device provided in the present invention works and what effect it offers while the window covering 1 is being raised or lowered. Please refer to FIG. 6 and FIG. 7, in which the resistance device 61 on the right side of FIG. 2 is illustrated with the corresponding lifting cord 51, wherein the base 610 is shown see-through and drawn with dotted lines, so that the change of positions and the relationships between the components inside the base 610 in different states can be revealed. While the bottom rail 30 of the window covering 1 is being moved in a direction that changes the covering material 20 toward a retracted state (i.e., while the lifting cord 51 is being gradually rewound around the corresponding reeling wheel 521 of the actuating unit 52), the lifting cord 51 moves in the first direction D1, as shown in FIG. 6. When the lifting cord 51 moves, the moving member 612 and a segment of the lifting cord 51 which contacts the moving member 612 would have friction created therebetween. Therefore, while pulling the lifting cord 51, the moving member 612 would be driven to move inside the channel 6101 in the first direction D1 along with the lifting cord 51 (in FIG. 6, it means the moving member 612 would be moved left along the supporting portion 6101*c*). In other words, the moving member 612 would be moved toward the first restriction portion 6101*a*. When the moving member 612 is moved to a position that it touches the first restriction portion 6101*a*, a top end of the moving member 612 would merely slightly push against the first free end 611*b* of the friction member 611, so that the first free end 611*b* of the friction member 611 would have a first elastic deformation amount relative to the main portion 611*a*. Therefore, the lifting cord 51 clamped between the friction member 611 and the moving member 612 would encounter a first resistance during said movement. While the bottom rail 30 of the window covering 1 is being moved in a direction that changes the covering material 20 toward an expanded state (i.e., while the lifting cord 51 is being gradually released from the reeling wheel 521 of the actuating unit 52), the lifting cord 51 moves in the second direction D2, as shown in FIG. 7. When the lifting cord 51 moves in the second direction D2, the moving member 612 would be driven to move inside the channel 6101 in the second direction along with the lifting cord 51 (in FIG. 7, it means the moving member 612 would be moved right along the supporting portion 6101*c*). In other words, the moving member 612 would be moved toward the second restriction portion 6101*b*. When the moving member 612 is moved to a position that it touches the second restriction portion 6101*b*, the top end of the moving member 612 would significantly push against the first free end 611*b* of the friction member 611, so that the first free end 611*b* of the friction member 611 would have a second elastic deformation amount relative to the main portion 611*a* which is greater than the first elastic deformation amount mentioned above. Therefore, the lifting cord 51 clamped between the friction member 611 and the moving member 612 would encounter a second resistance greater than the first resistance mentioned above during said movement. In this way, the resistance device 61 could provide resistances of different magnitudes (e.g., the first and the second resistances) to the lifting cord 51 when the lifting cord 51 moves in different directions. With such design, while the bottom rail 30 is being raised and lowered, the resistance device 61 could help to maintain the overall balance of the window covering 1 by correspondingly dealing with the change in the rewinding force of the spring and the downward pulling force created by the weight of the covering material.

Figure 8:
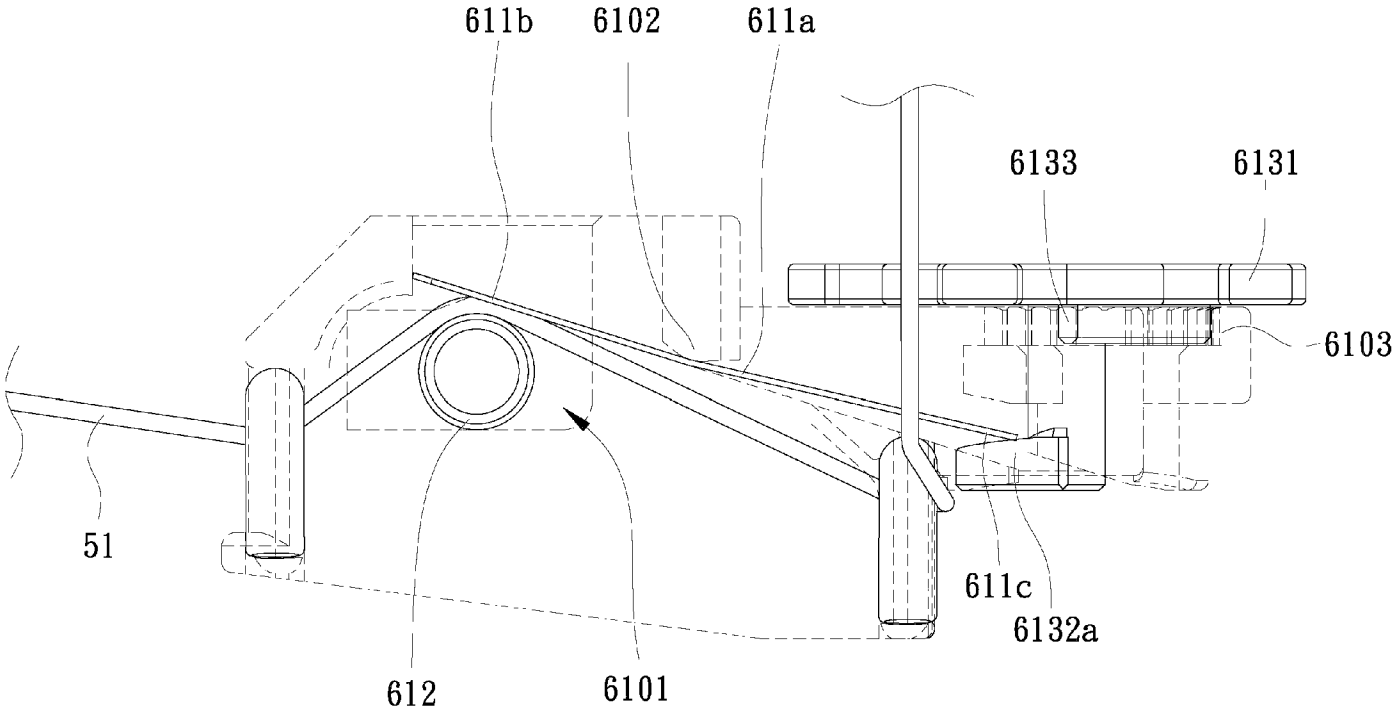
FIG. 8 is a schematic view showing that the adjusting member of the resistance device is located at another position.
Figure 9A:
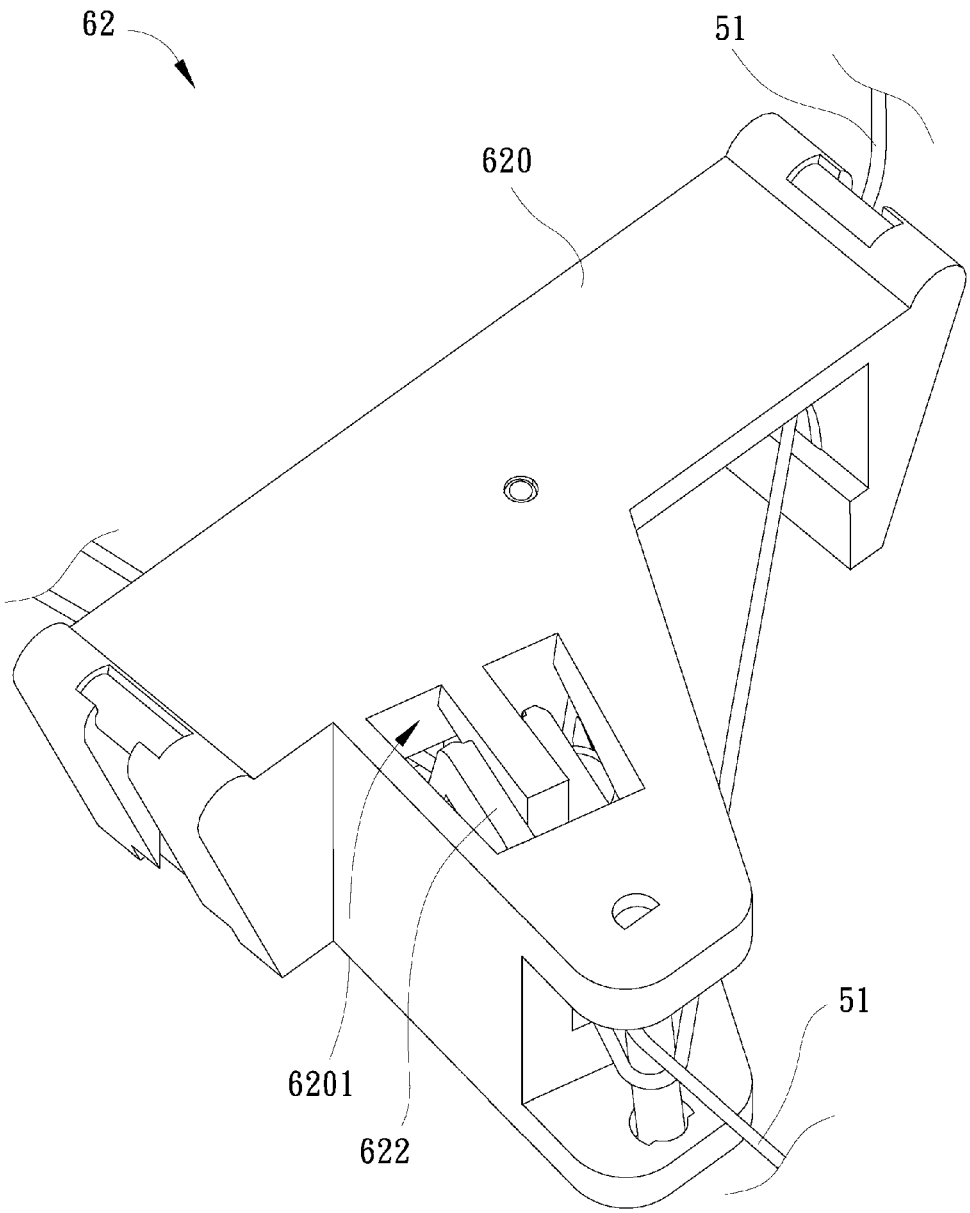
FIG. 9A is a perspective view of the resistance device of a second embodiment of the present invention.
Figure 9B:
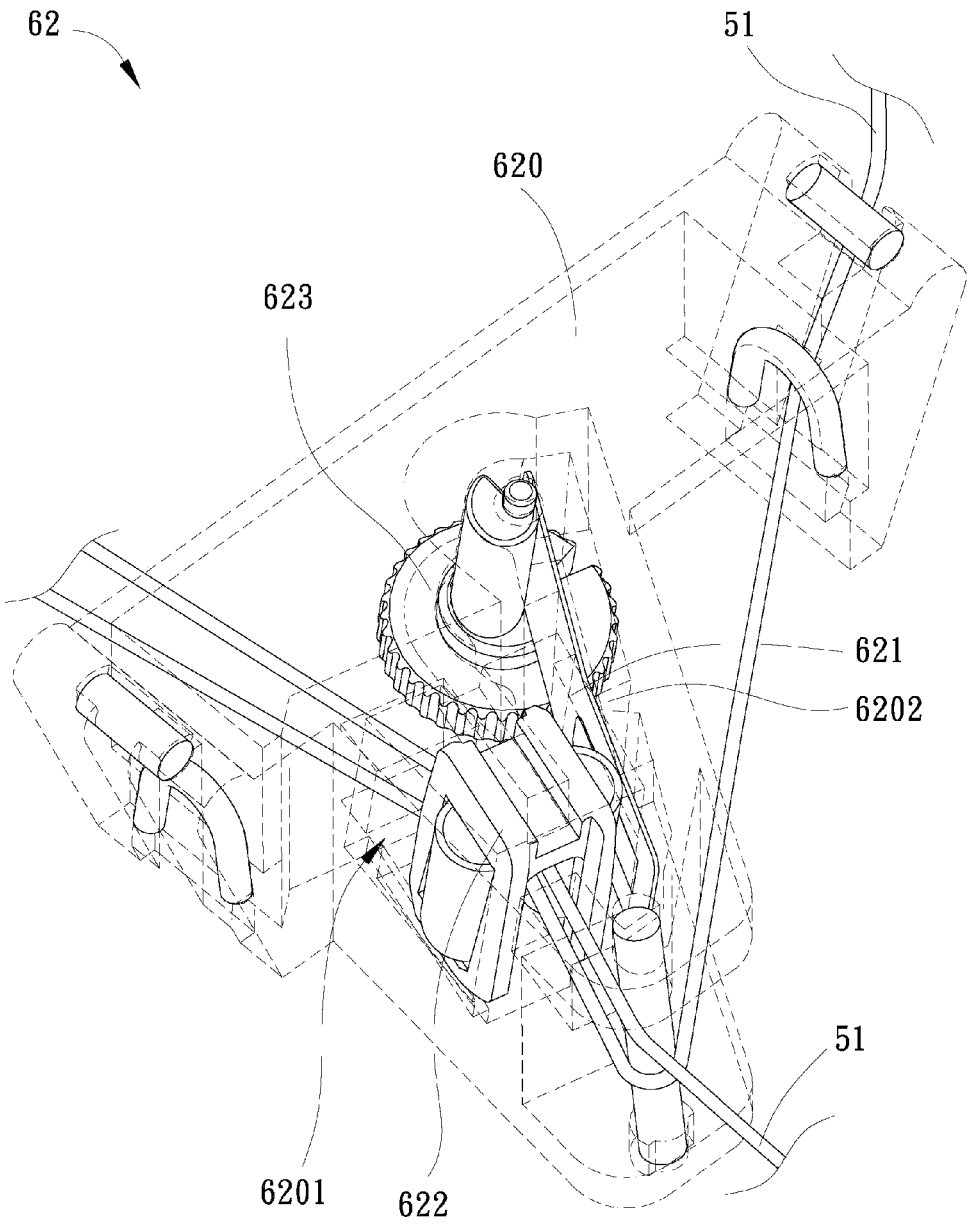
Figure 10A:
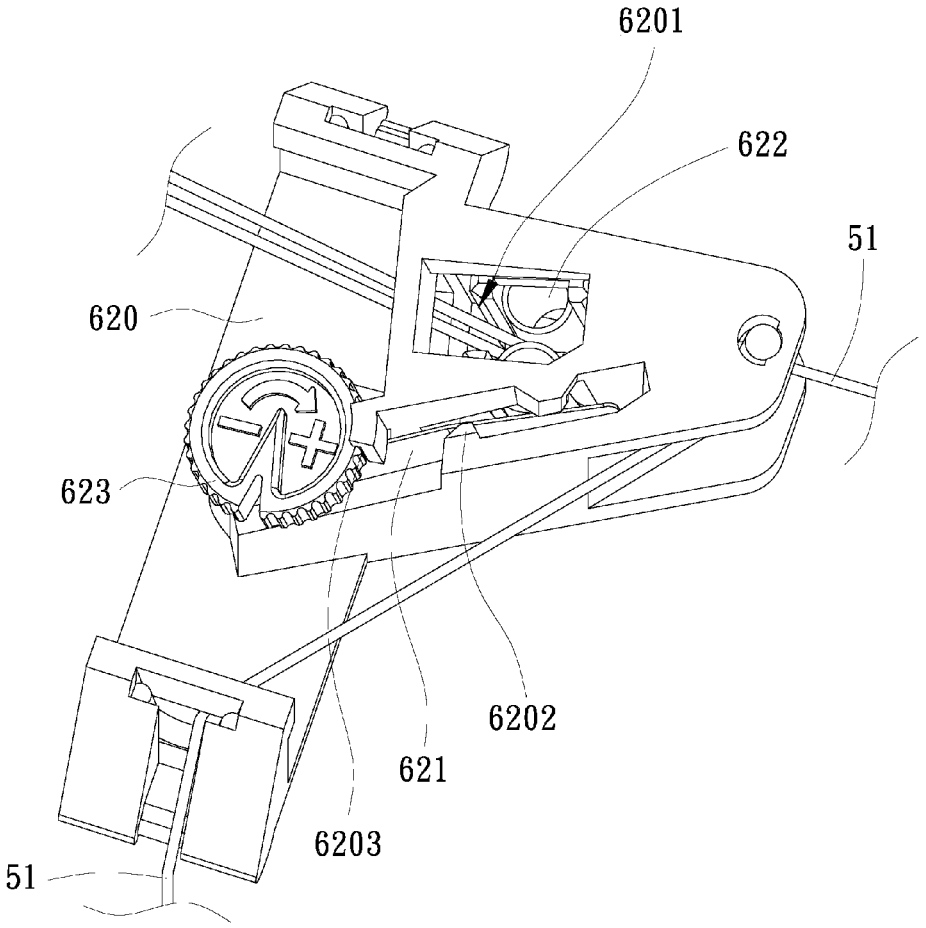
FIG. 10A is a perspective view of the resistance device of FIG. 9A seen from another angle.
Figure 10B:
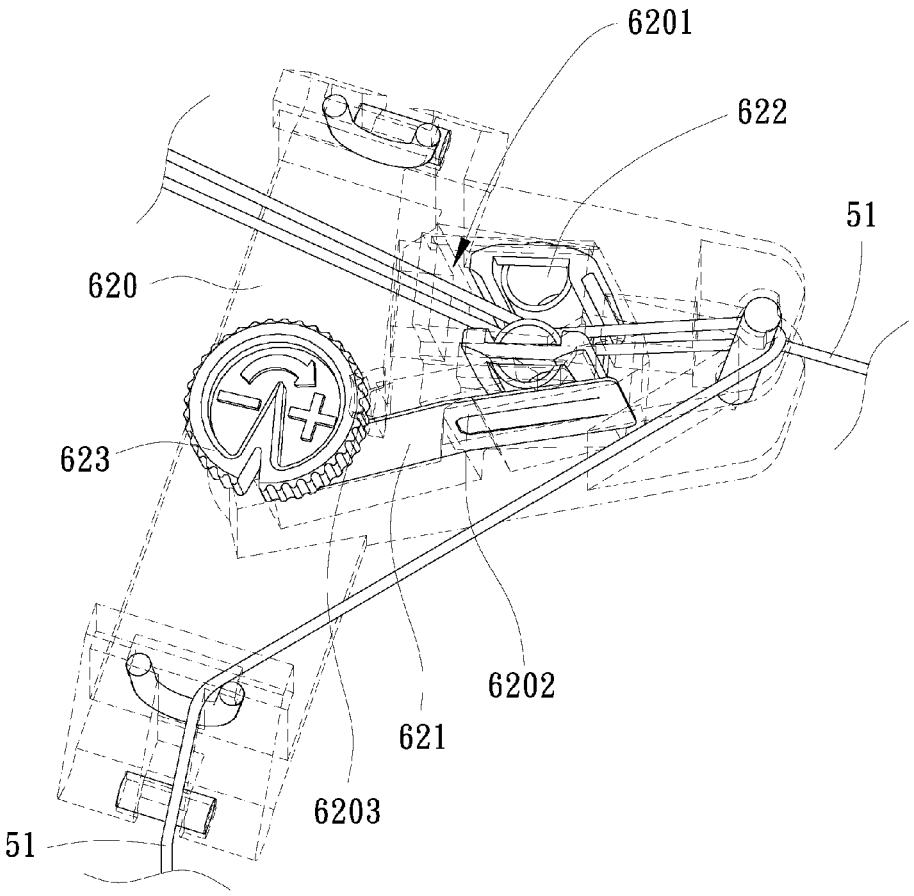

Herein we are going to further describe the function of the adjusting member 613 with FIG. 6 and FIG. 8 as references. The operating end 6131 exposed out of the base 610 could be operated to rotate the adjusting member 613. In this way, the overall position of the adjusting member 613 relative to the base 610 could be changed, whereby to adjust the prestress provided by the friction member 611 to the lifting cord 51. When in the condition shown in FIG. 6, the second free end 611*c* of the friction member 611 contacts the low point 6132*b* of the sloping actuating end 6132. At this time, the friction member 611 applies a prestress onto the lifting cord 51, which is defined as a first prestress herein. When the operating end 6131 of the adjusting member 613 is operated by an external force to rotate, the protruding second engaging portion 6133 and the actuating end 6132 rotate synchronously. The second engaging portion 6133 is rotated and then engages with another one of the recesses of the first engaging portion 6103 which is a toothed ring with inner teeth, so that a portion of the actuating end 6132 that contacts the second free end 611*c* of the friction member 611 changes from the low point 6132*b* to the high point 6132*a* of the slope, as shown in FIG. 8. Correspondingly, the second free end 611*c* would bend upward relative to the main portion 611*a* which abuts against the support 610, for the second free end 611*c* no longer contacts the low point 6132*b*, but the high point 6132*a* instead. As a result, the first free end 611*b* which is opposite to the second free end 611*c* would bend downward. However, since the first free end 611*b* has pressed against the lifting cord 51 in the first place, and is supported by the moving member 612, the first free end 611*b* would only have limited space for its downward bending. Therefore, the prestress provided by the friction member 611 to the lifting cord 51 would increase, and herein we define the increased prestress as a second prestress. It is worth mentioning that, the position change between the high point 6132*a* and the low point 6132*b* mentioned above is only to clearly express the difference between the situations corresponding to the two limit positions of the adjusting member 623. Since the toothed ring of the first engaging portion 6103 has multiple recesses, the rotating angle of the adjusting member 613 could be adjusted in multiple steps, so that the actuating end 6132 of the adjusting member 613 and the second free end 611*c* of the friction member 611 could press against each other at one of multiple positions between the high point 6132*a* and the low point 6132*b*. In other words, the prestress exerted to the lifting cord 51 by the friction member 611 could be adjusted in multiple steps. In this way, the resistance applied onto the lifting cord 51 passing through the resistance device 61 would not be merely limited to the first resistance and the second resistance. Therefore, the resistance device provided in the present invention could be flexibly applied for window coverings of various sizes and types.

Figure 11:
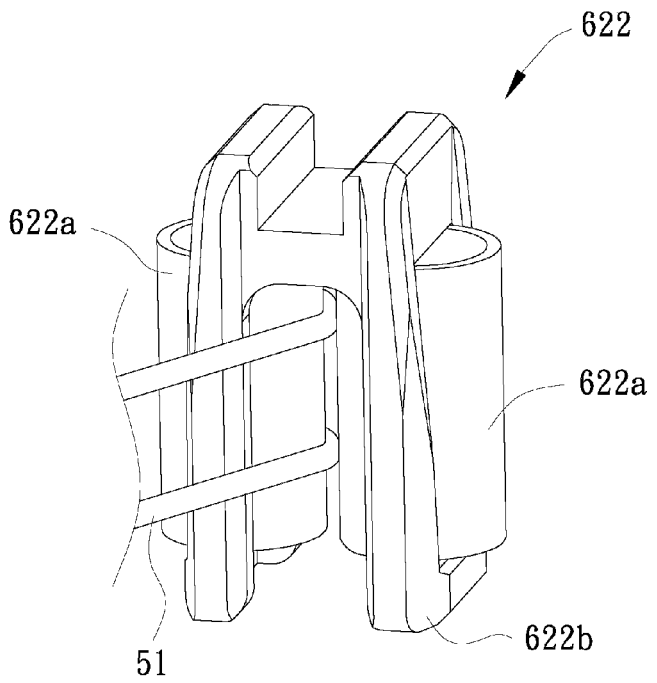
FIG. 11 is a perspective view of the moving member of the resistance device of FIG. 9B.
Figure 12:
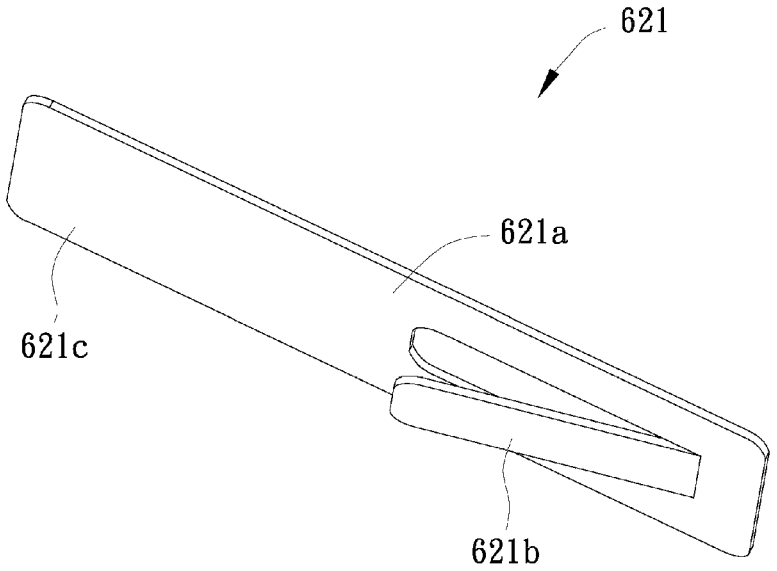
FIG. 12 is a perspective view of the friction member of the resistance device of FIG. 9B.
Figure 13:
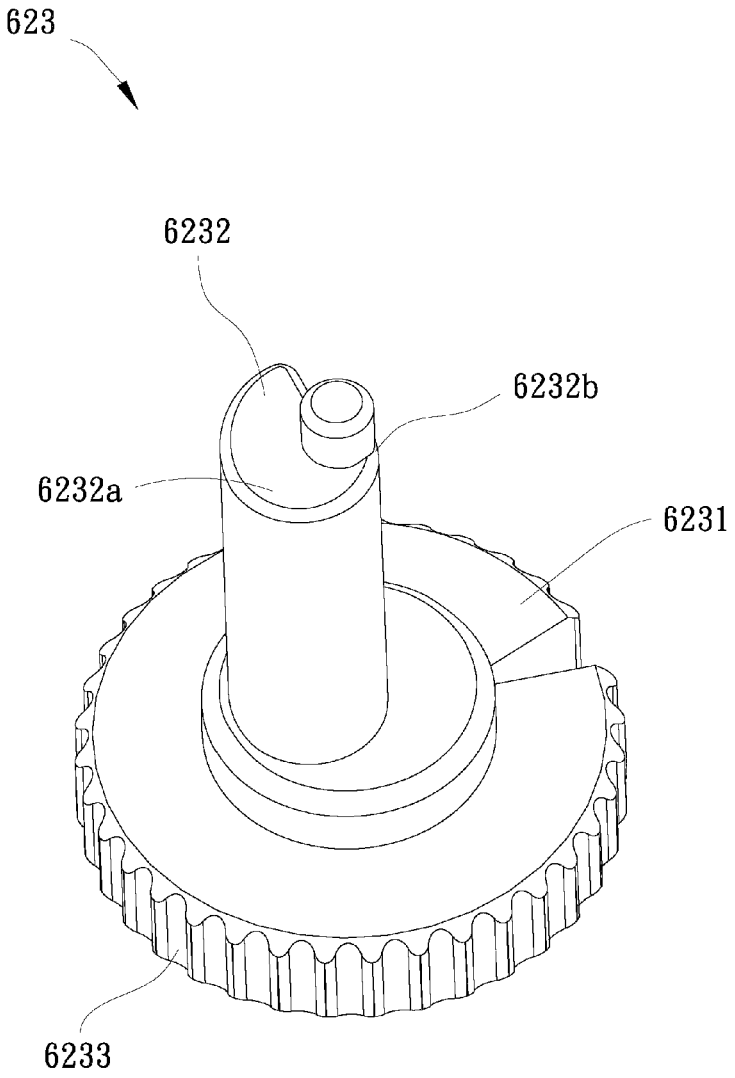
FIG. 13 is a perspective view of the adjusting member of the resistance device of FIG. 9B.
Figure 14A:
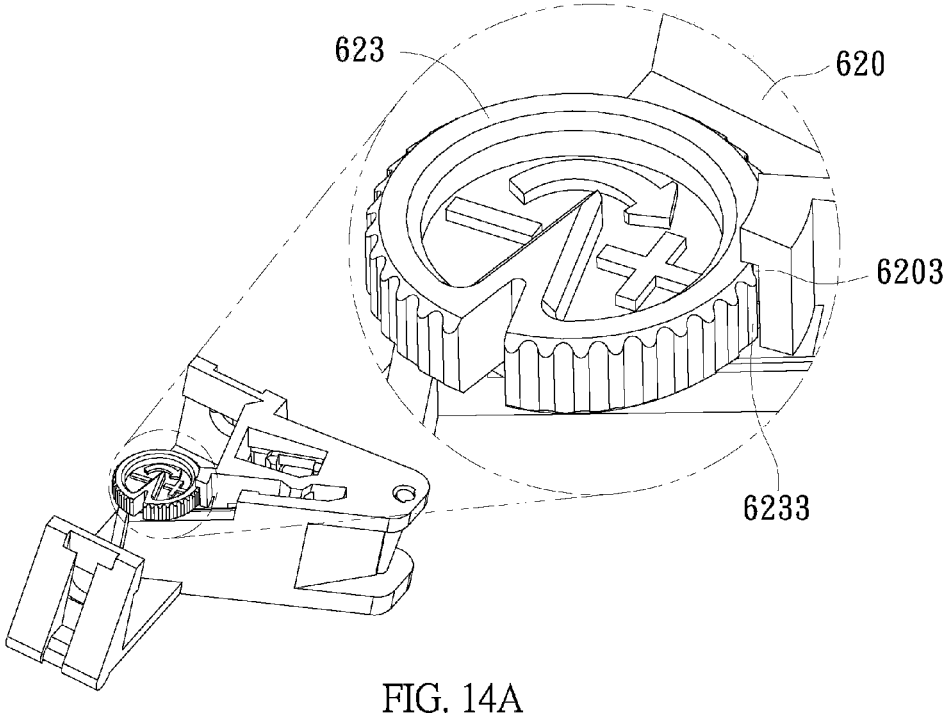
FIG. 14A is an enlarged schematic view showing the fitting of the resistance device of the second embodiment between the first engaging portion of the base and the second engaging portion of the adjusting member.
Figure 14B:
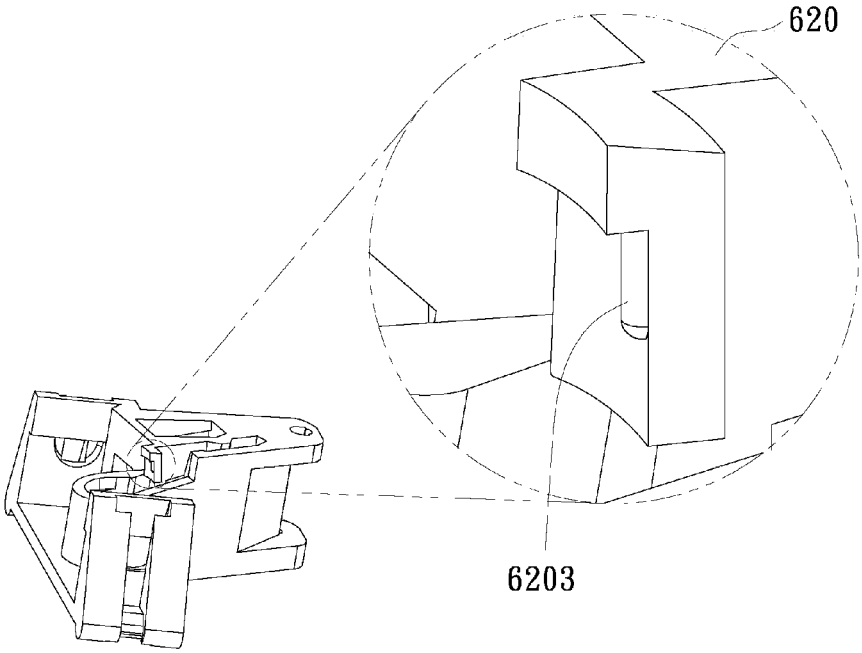
FIG. 14B is an enlarged schematic view of the first engaging portion of the base of the resistance device of the second embodiment.

A resistance device of a second embodiment of the present invention is shown in FIG. 9A to FIG. 17, in which the structures are illustrated in detail. Similarly, the resistance device 62 includes a base 620, in which there also are a friction member 621, a moving member 622, and an adjusting member 623. The main difference between the current embodiment and the previous embodiment is how the moving member 622 is implemented. The moving member 622 is shown in FIG. 9B and FIG. 10B. In these figures, the base 620 is illustrated as see-through and drawn in dotted lines, so the components inside the base 620 can be revealed. The base 620 has a channel 6201, which allows the moving member 622 to move back and forth therein. The channel 6201 is an open slot which is substantially trapezoidal, and the walls of the open slot define a first end 6201*a*, which has a wider space, and a second end 6201*b*, which has a narrower space (as it can be seen in FIG. 15), wherein the first end 6201*a* is, by definition, a first restriction portion which determines the leftmost position that the moving member 622 could reach, and the second end 6201*b* is, also by definition, a second restriction portion which determines the rightmost position that the moving member 622 could reach. Moreover, the wall connecting the first restriction portion and the second restriction portion is a supporting portion 6201*c*. Understandably, although the supporting portion 6201*c* is formed by continuous walls in the current embodiment, this is not a limitation of the present invention. In other embodiments, the supporting portion 6201*c* can be also composed of multiple ribs or supports provided at intervals, as long as supporting portion 6201*c* can support the moving member 622 for its back-and-forth movement. In the current embodiment, the moving member 622 is a component with two rolling rods, as shown in FIG. 11. The two rolling rods 622*a* are provided at a case 622*b* in a movable manner. Furthermore, the two rolling rods 622*a* are not separable from the case 622*b*, and therefore can be moved along with the case 622*b*. In addition, the two rolling rods 622*a* have a gap in between, allowing the lifting cord 51 to pass through. A recess on a top of the case 622*b* matches a rail of the channel 6201, and therefore the case 622*b* can slide in the channel 6201. The overall movement of the moving member 622 is restricted within the above-mentioned first restriction portion, second restriction portion, and supporting portion 6201*c* of the channel 6201. The friction member 621 is a spring sheet, which has a main portion 621*a*, a first free end 621*b* on a side of the main portion 621*a*, and a second free end 621*c* on an opposite side of the main portion 621*a*. Furthermore, the first free end 621*b* is an elastic tongue extruding out of the main portion 621*a* (as shown in FIG. 12). Understandably, the friction member 621 is not limited to be the implementation disclosed in the current embodiment; it can also be other kinds of spring sheets similar to that of the previous embodiment, or other structures which can provide equivalent effects. The friction member 621 is provided on a side of the moving member 622, and its first free end 621*b* presses against one of the rolling rods 622*a* of the moving member 622. The main portion 621*a* of the friction member 621 abuts against the support 6202 of the base 620, and therefore gets supported thereby. The second free end 621*c* of the friction member 621 is provided corresponding to the adjusting member 623. The adjusting member 623 is provided on the base 620 in a manner that the adjusting member 623 is rotatable relative to the base 620. Furthermore, the adjusting member 623 has an operating end 6231, an actuating end 6232, and a second engaging portion 6233 which is used to fix a position of the adjusting member 623. The operating end 6231 is a rotating disc exposed out of the base 620, and a periphery of the rotating disc is the second engaging portion 6233. In the current embodiment, the second engaging portion 6233 is a toothed ring with outer teeth, as shown in FIG. 13, FIG. 14A, and FIG. 14B. The toothed ring has multiple recesses to match a first engaging portion 6203 (which is a protrusion in the current embodiment) of the base 620. The actuating end 6232 is a cam which has a high point 6232*a* and a relatively low point 6232*b*. In the current embodiment, the lifting cord 51 passes through a gap between the two rolling rods 622*a* of the moving member 622, and is pushed by the friction member 621 to be clamped between the two rolling rods 622*a*.

Figure 15:
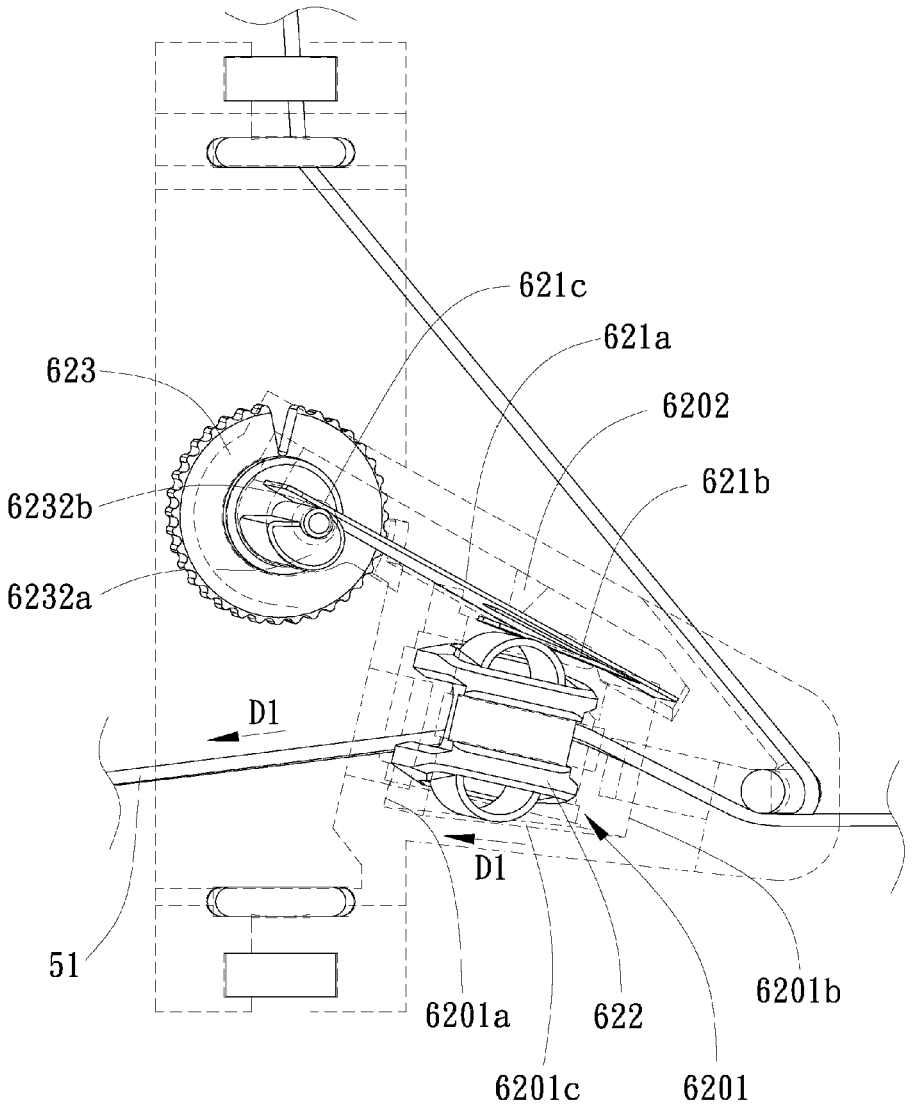
FIG. 15 is a schematic view showing the condition of the resistance device of the second embodiment when the lifting cord is moved in the first direction.
Figure 16:
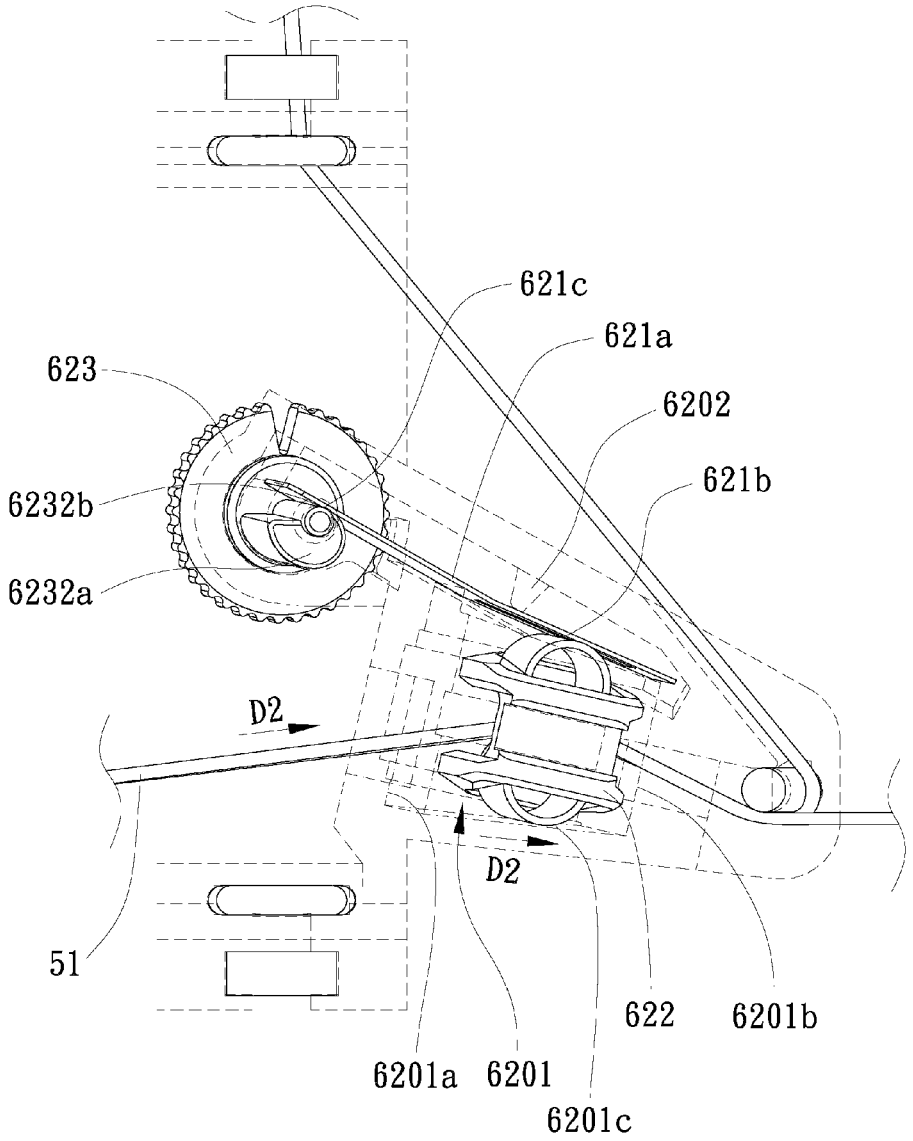
FIG. 16 is a schematic view showing the condition of the resistance device of the second embodiment when the lifting cord is moved in the second direction.

Herein we will describe the function and effect that the resistance device 62 provides when the window covering 1 is being raised or lowered. In the following paragraphs, the resistance device 62 is installed on a right side of the actuating unit 52 of the window covering 1 as an example. In FIG. 15 and FIG. 16, the base 620 is shown see-through and is drawn in dotted lines, so that the change in the positions of the components inside the base 620 can be seen. When the bottom rail 30 of the window covering 1 is being moved to change the covering material 20 toward a retracted state, i.e., when the lifting cord 51 is being gradually retreated to the reeling wheel 521 of the actuating unit 52, the lifting cord 51 moves in the first direction D1, as shown in FIG. 15. The lifting cord 51, which passes through the resistance device 62, would drive the moving member 622 to move in the channel 6201 along with the lifting cord 51 in the first direction D1 (in FIG. 15, it is the direction to the left), which means the moving member 622 is being moved toward the first restriction portion (i.e., the first end 6201*a*). When the moving member 622 is moved to the first end 6201*a* (the wider end) of the channel 6201, a top of the moving member 622 merely slightly presses the first free end 621*b* (which is a protruding elastic tongue, as mentioned above) of the friction member 621, so that the first free end 621*b* of the friction member 621 would have a first elastic deformation amount relative to the main portion 621*a*, and therefore the lifting cord 51 which is clamped between the two rolling rods 622*a* of the moving member 622 would encounter a first resistance during its movement. When the bottom rail 30 of the window covering 1 is being moved to change the covering material 20 toward an extended state, i.e., when the lifting cord 51 is being gradually released from the reeling wheel 521 of the actuating unit 52, the lifting cord 51 moves in the second direction D2, as shown in FIG. 16. The lifting cord 51, which passes through the resistance device 62, would drive the moving member 622 to move in the channel 6201 along with the lifting cord 51 in the second direction D2 (in FIG. 16, it is the direction to the right), which means the moving member 622 is being moved toward the second restriction portion (i.e., the second end 6201*b*). When the moving member 622 is moved to the second end 6201*b* (the narrower end) of the channel 6201, the top end of the moving member 622 would further strengthen the pressing against the protruding and elastic first free end 621*b* of the friction member 621, so that the first free end 621*b* of the friction member 621 would have a second elastic deformation amount relative to the main portion 621*a*, wherein the second elastic deformation amount is greater than the first elastic deformation amount mentioned above. At the same time, the gap between the rolling rods 622*a* of the moving member 622 would become narrower due to the pushing of the supporting portion 6201*c* of the channel 6201 and the first free end 621*b* of the friction member 621. Therefore, as being clamped between the two rolling rods 622*a* of the moving member 622, the lifting cord 51 would encounter a second resistance greater than the previously mentioned first resistance during its movement. In this way, the resistance device 62 could provide resistances of different magnitudes, such as the first resistance and the second resistance, to the lifting cord 51 when the lifting cord 51 moves in different directions, whereby to deal with the rewinding force of the spring and the change in the pulling force caused by the weight of the covering material 20 when the bottom rail 30 is being raised or lowered. As a result, the overall balance of the window covering 1 could be maintained.

Figure 17:
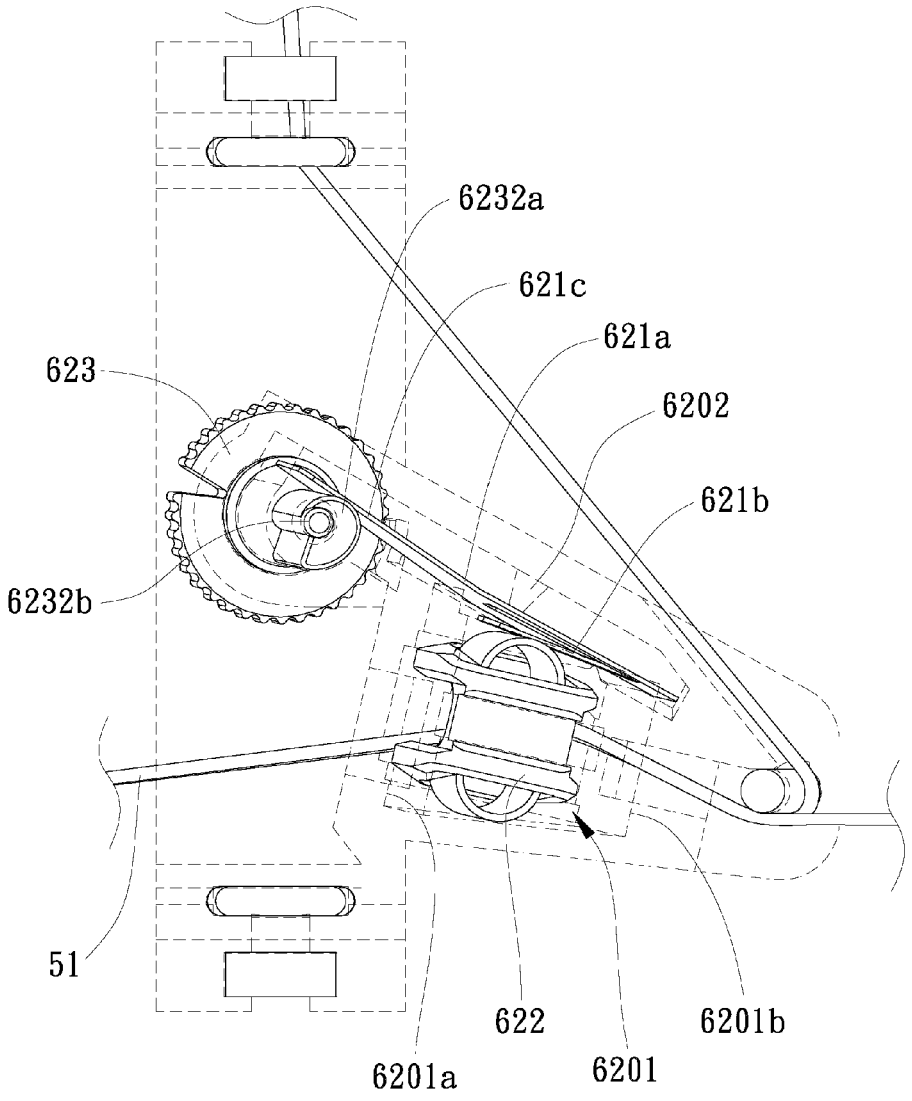
FIG. 17 is a schematic view showing that the adjusting member of the resistance device is located at another position.
Figure 18A:
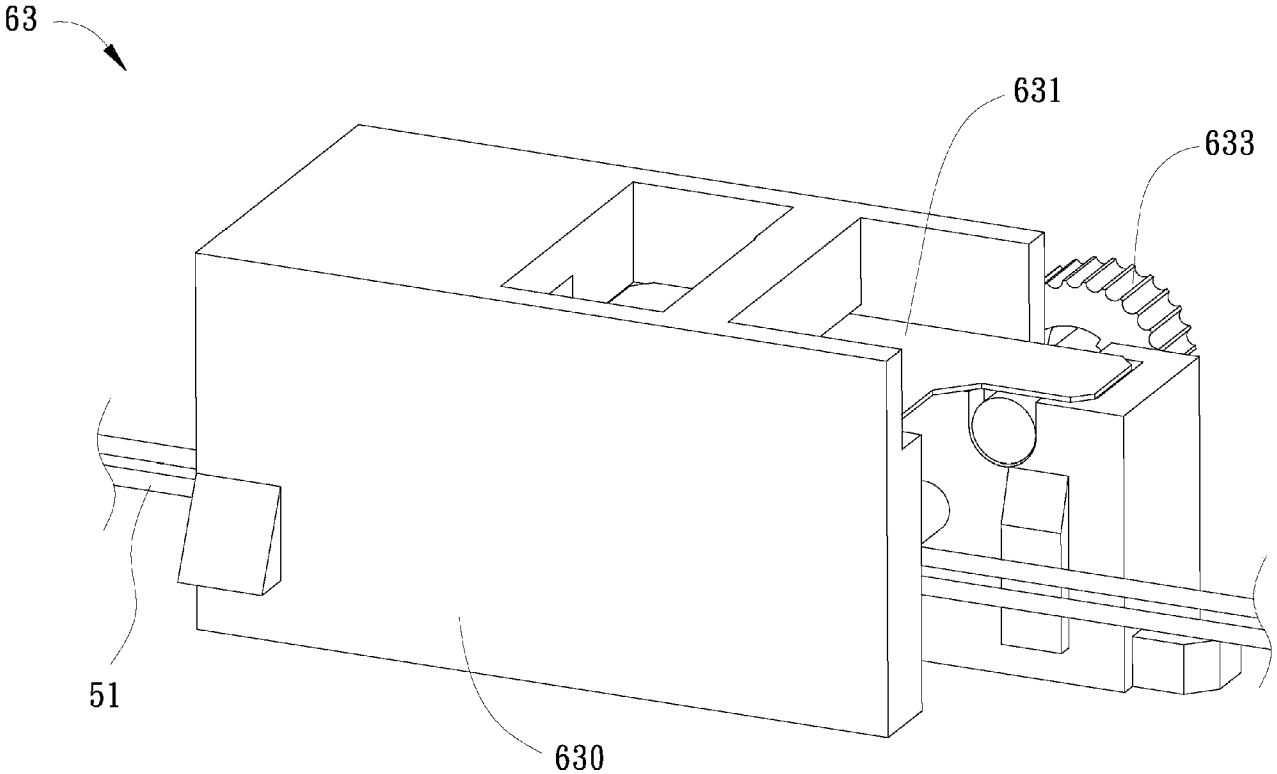
FIG. 18A is a perspective view of the resistance device of a third embodiment of the present invention.
Figure 18B:
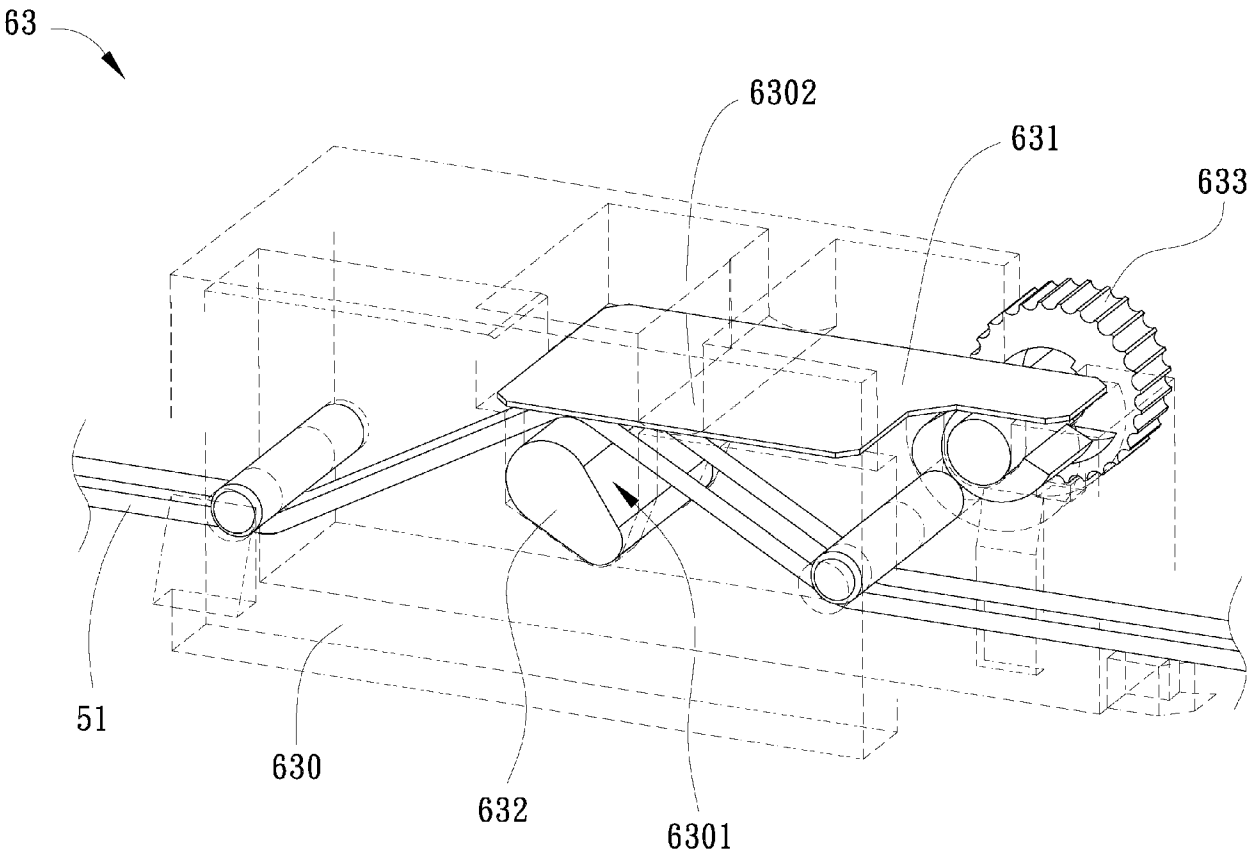
Figure 19:
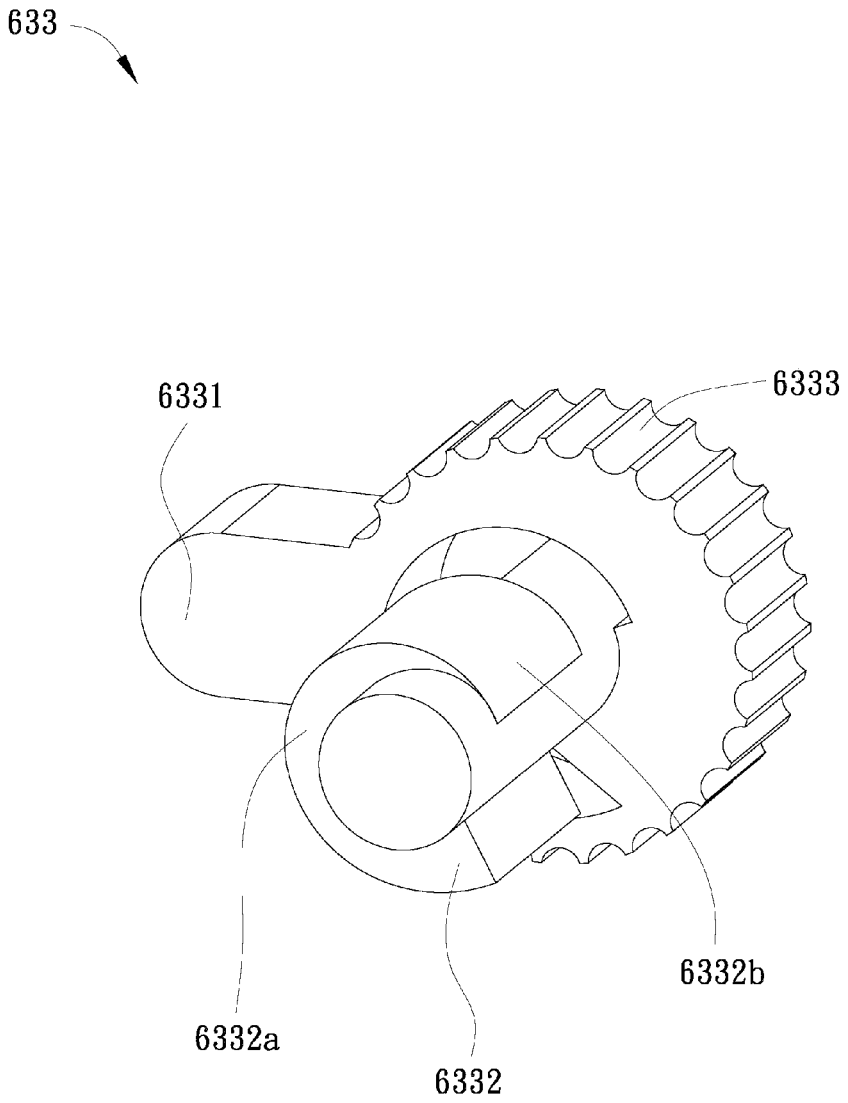
FIG. 19 is a perspective view of the adjusting member of the resistance device of FIG. 18B.

The function of the adjusting member 623 is further described in the following paragraph, along with FIG. 15 and FIG. 17. The adjusting member 623 is different from the adjusting member 613 of the aforementioned first embodiment by that, the actuating end 6232 of the adjusting member 623 is a cam having a high point 6232*a* and a relatively low point 6232*b*. The operating end 6231 exposed out of the base 620 can be used to rotate the adjusting member 623 and therefore change its overall position relative to the base 620, whereby to adjust the prestress provided by the friction member 621 to the lifting cord 51. As shown in FIG. 15, the second free end 621*c* of the friction member 621 contacts the low point 6232*b* of the actuating end 6232 (i.e., the cam) at the moment, and therefore the friction member 621 exerts a prestress to the lifting cord 51. Herein we define said prestress is a first prestress. When the operating end 6231 of the adjusting member 623 is rotated by an external force, the second engaging portion 6233 and the actuating end 6232 are rotated synchronously. After being rotated, the toothed ring-shaped second engaging portion 6233 would allow the protruding first engaging portion 6203 of the base 620 to fit into another recess of the toothed ring of the second engaging portion 6233, making the actuating end 6232 and the second free end 621*c* of the friction member 621 contact each other at the relatively high point 6232*a* of the cam instead of the low point 6232*b*, as shown in FIG. 17. Consequently, since the second free end 621*c* no longer contacts the low point 6232*b*, but contacts the high point 6232*a*, the second free end 621*c* would therefore bend upward relative to the main portion 621*a* which abuts against the support 6202, which causes the first free end 621*b* opposite to the second free end 621*c* to bend downward. Meanwhile, the gap between the rolling rods 622*a* of the moving member 622 would also become narrower due to the pushing of the first free end 621*b* of the friction member 621, so that the prestress provided by the friction member 621 to the lifting cord 51 would increase. Herein we define this increased prestress as a second prestress, and the second prestress is greater than the first prestress. It is worth mentioning that, the position change between the high point 6232*a* and the low point 6232*b* mentioned above is only to clearly express the difference between the situations corresponding to the two limit positions of the adjusting member 623. Since the toothed ring of the second engaging portion 6233 has multiple recesses, the rotating angle of the adjusting member 623 could be adjusted in multiple steps, so that the actuating end 6232 of the adjusting member 623 and the second free end 621*c* of the friction member 621 could press against each other at one of multiple positions between the high point 6232*a* and the low point 6232*b*. In other words, the prestress provided by the friction member 621 could be adjusted in multiple steps. In this way, the resistance applied onto the lifting cord 51 passing through the resistance device 62 would not be merely limited to the first resistance and the second resistance. Therefore, the resistance device provided in the present invention could be flexibly applied for window coverings of various sizes and types.

Figure 20:
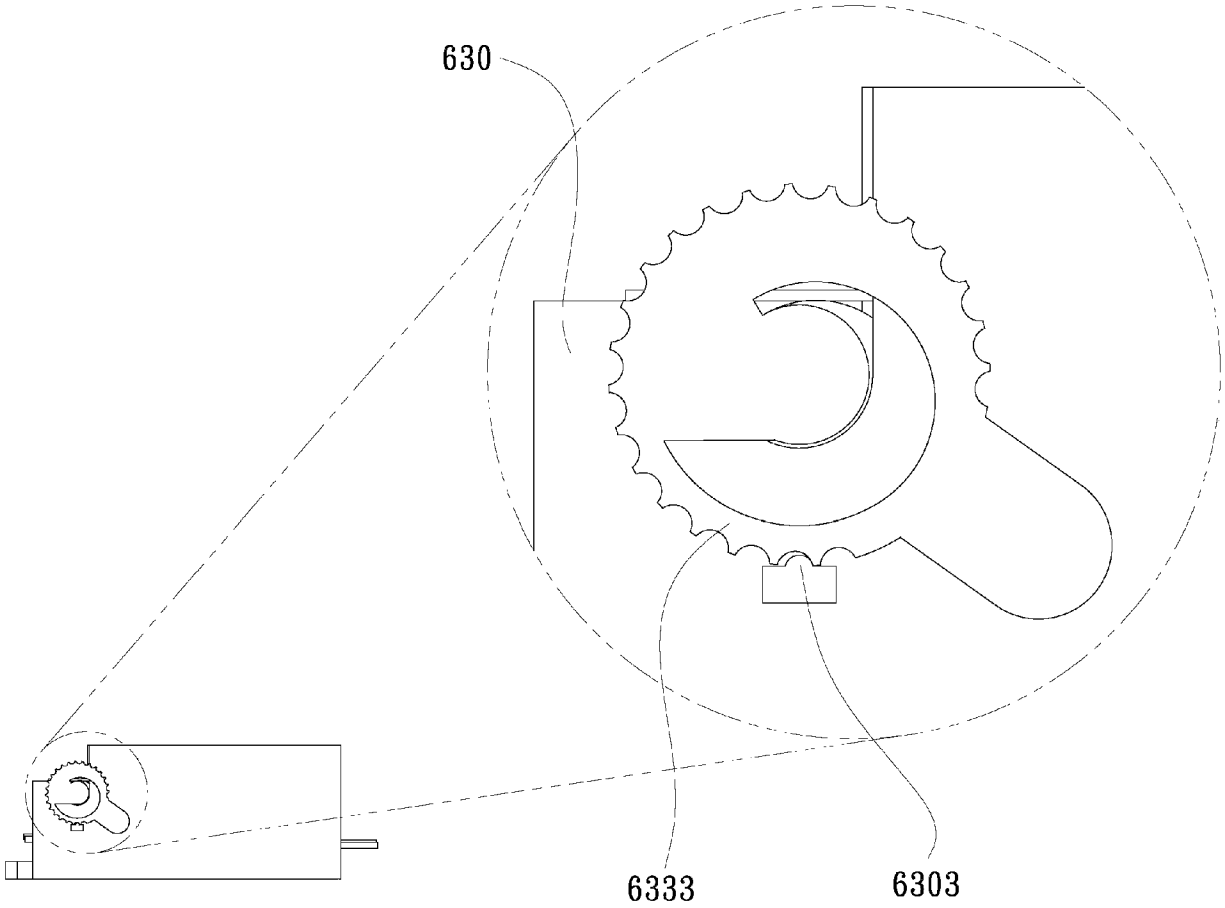
FIG. 20 is an enlarged schematic view showing the fitting of the resistance device of the third embodiment between the first engaging portion of the base and the second engaging portion of the adjusting member.
Figure 21:
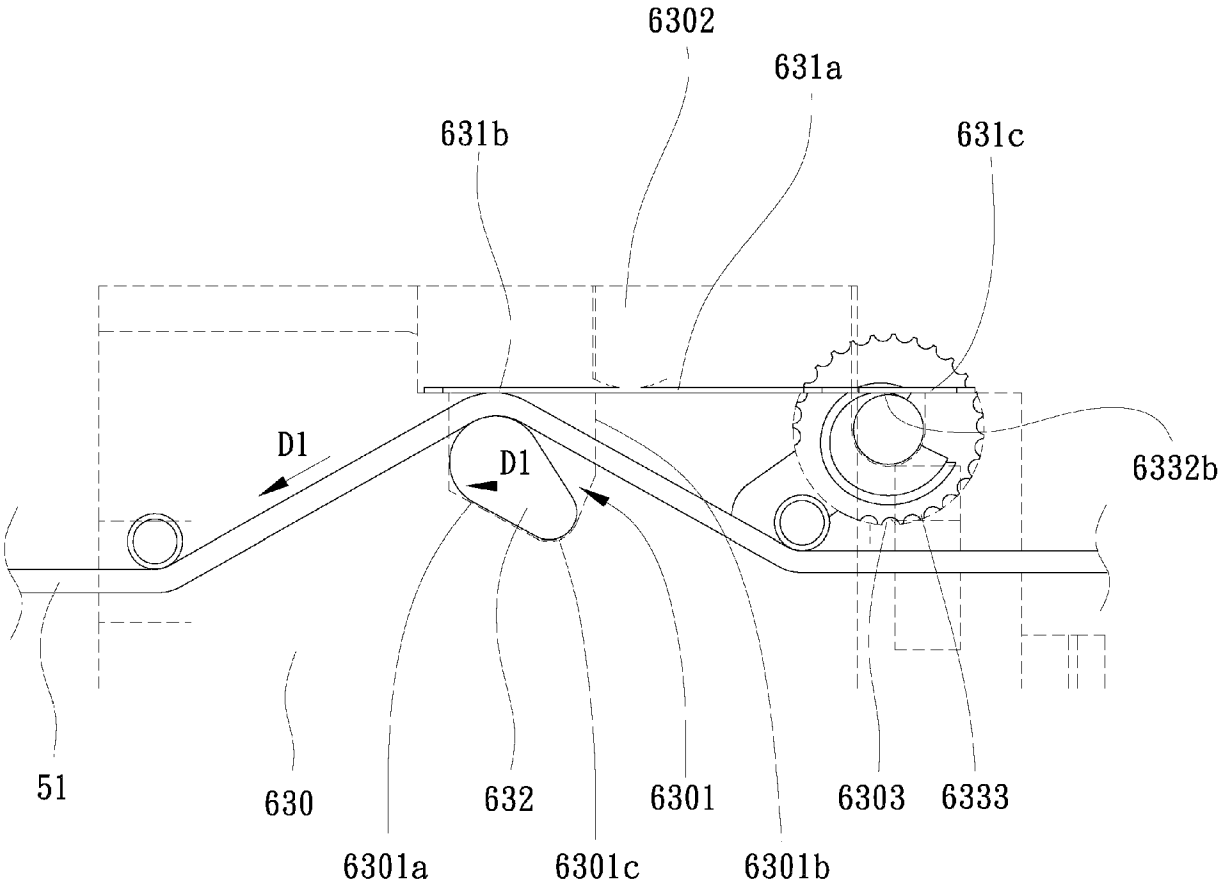
FIG. 21 is a schematic view showing the condition of the resistance device of the third embodiment when the lifting cord is moved in the first direction.

A resistance device of a third embodiment of the present invention is shown in FIG. 18A to FIG. 25, in which the detailed structure is illustrated. Similarly, the resistance device 63 has a base 630, and also has a friction member 631, a moving member 632, and an adjusting member 633 in the base 630, wherein the cord 51 passes through a space between the friction member 631 and the moving member 632. An actuating end 6332 of the adjusting member 633 is shaped like a cam. The moving member 632 is provided in a channel 6301 of the base 630. The base 630 in FIG. 18B is shown see-through and is drawn in dotted lines, so that the arrangement of the components inside the base 630 can be revealed. The base 630 has a channel 6301, which is a passage with continuous walls composed of a first restriction portion 6301*a*, a second restriction portion 6301*b*, and a supporting portion 6301*c*, and allows the moving member 632 to move therein. The moving member 632 is substantially shaped like a droplet, of which an end is small and another end is big. With such shape, the moving member 632 could use the end thereof as a support to swing relative to the supporting portion 6301*c* from side to side in the channel 6301. The friction member 631 is a spring sheet, which has a main portion 631*a*, and a first free end 631*b* and a second free end 631*c* respectively located on two sides of the main portion 631*a*, as shown in FIG. 21. The friction member 631 is located on a side of the moving member 632, and the first free end 631*b* thereof is adjacent to the moving member 632. The main portion 631*a* of the friction member 631 abuts against a support 6302 of the base 630, and the second free end 631*c* is provided corresponding to the adjusting member 633. The adjusting member 633 is provided on the base 630 in a manner that the adjusting member 630 is rotatable relative to the base 630, and has an operating end 6331, an actuating end 6332, and a second engaging portion 6333. The operating end 6331 is a handle exposed out of the base 630, and has a rotating disc. A periphery of the rotating disc is a toothed ring with outer teeth, wherein the toothed ring is the second engaging portion 6333, which has multiple recesses to match the first engaging portion 6303 (a protrusion) of the base 630, as shown in FIG. 20. The actuating end 6332 is a cam with a high point 6332*a* and a relatively low point 6332*b*. The lifting cord 51 passes through the space between the moving member 632 and the friction member 631 to be clamped therebetween.

Figure 22:
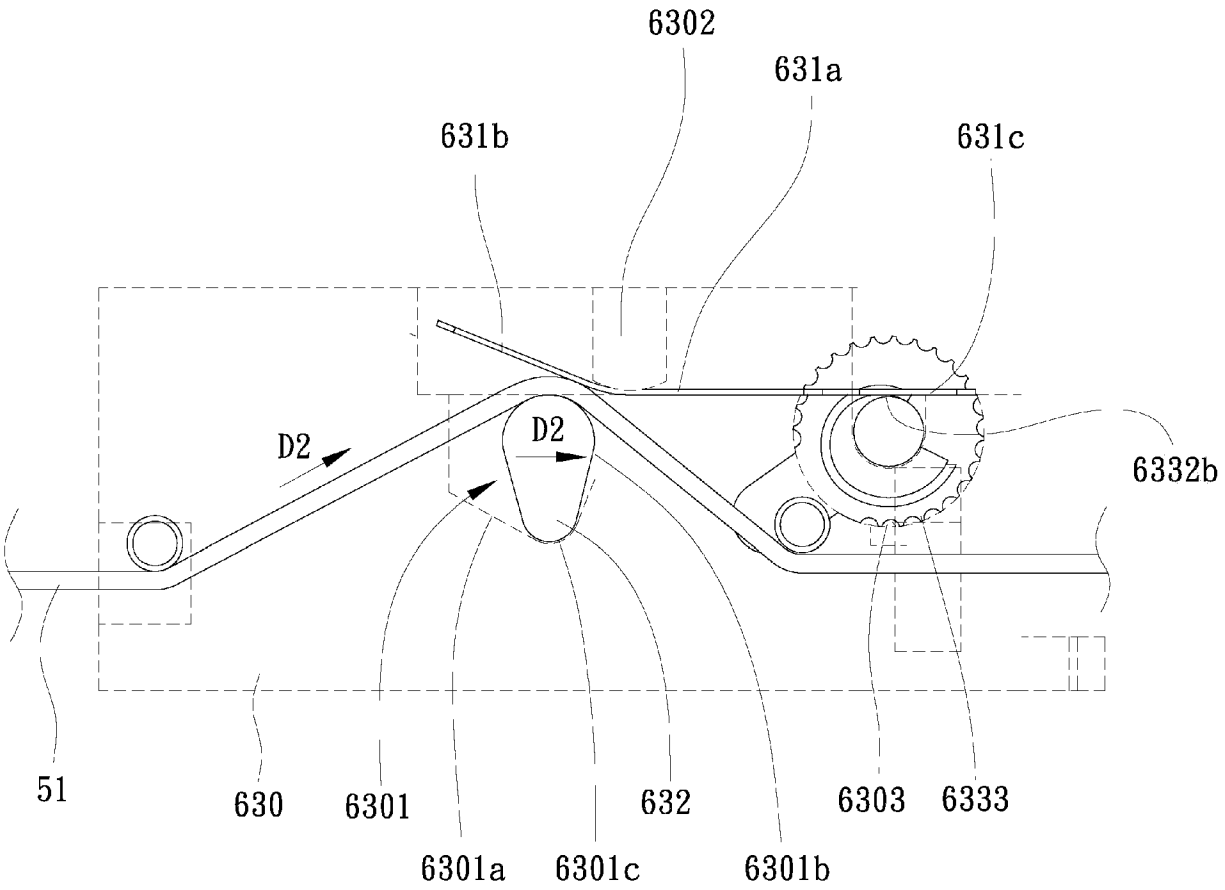
FIG. 22 is a schematic view showing the condition of the resistance device of the third embodiment when the lifting cord is moved in the second direction.

In the following paragraphs, we are going to describe the function and effect that the resistance device 63 could provide when the window covering 1 is being raised or lowered. Herein the resistance device 63 is installed on a right side of the actuating unit 52 of the window covering 1 for illustration purpose, as shown in FIG. 21 and FIG. 22. In these figures, the base 630 is shown see-through and is drawn with dotted lines, so that the change in the position of the components inside the base 630 can be revealed. When the bottom rail 30 of the window covering 1 is being moved to change the covering material 20 toward a retracted state, i.e., when the lifting cord 51 is being gradually retreated to wind around the reeling wheel 521 of the actuating unit 52, the lifting cord 51 is being moved in the first direction D1, as shown in FIG. 21. The lifting cord 51 which passes through the resistance device 63 would drive the moving member 632 to move in the channel 6301 along with the lifting cord 51 in the first direction D1 (in FIG. 21, it means the moving member 632 swings left relative to the supporting portion 6301*c*) so that the moving member 632 would be moved to a position that it touches the first restriction portion 6301*a*. In other words, the moving member 632 would be tilted at this time. When the moving member 632 is located at the position that it swings left, a top of the moving member 632 would merely slightly press the first free end 631*b* of the friction member 631, so that the first free end 631*b* has a first elastic deformation amount relative to the main portion 631*a*, and therefore the lifting cord 51 which is clamped between the friction member 631 and the moving member 632 would encounter a first resistance during its movement. When the bottom rail 30 of the window covering 1 is being moved to change the covering material 20 toward an extended state, i.e., when the lifting cord 51 is being gradually released from the reeling wheel 521 of the actuating unit 52, the lifting cord 51 is moved in the second direction D2, as shown in FIG. 22. The lifting cord 51 which passes through the resistance device 63 would drive the moving member 632 to move in the channel 6301 along with the lifting cord 51 in the second direction D2 (in FIG. 22, it means the moving member 632 swings right relative to the supporting portion 6301*c*) so that the moving member 632 would be moved to a position that it touches the second restriction portion 6301*b*. In other words, the moving member 632 would be upright at this time. When the moving member 632 is located at the position that it swings right, an end of the moving member 632 corresponding to the friction member 631 would further greatly press the first free end 631*b* of the friction member 631, so that the first free end 631*b* would have a second elastic deformation amount relative to the main portion 631*a*, wherein the second elastic deformation amount is greater than the aforementioned first elastic deformation amount. Therefore, the lifting cord 51 which is clamped between the friction member 631 and the moving member 632 would encounter a second resistance greater than the previously mentioned first resistance during its movement. As a result, the resistance device 63 could provide resistances of different magnitudes (e.g., the first and the second resistances) to the lifting cord 51 when the lifting cord 51 moves in different directions. In this way, the resistance device 63 provided in the present invention would deal with the rewinding force of the spring and the change in the pulling force created by the weight of the covering material 20 when the bottom rail is being raised or lowered. The overall balance of the window covering 1 could be therefore maintained.

Figure 24:
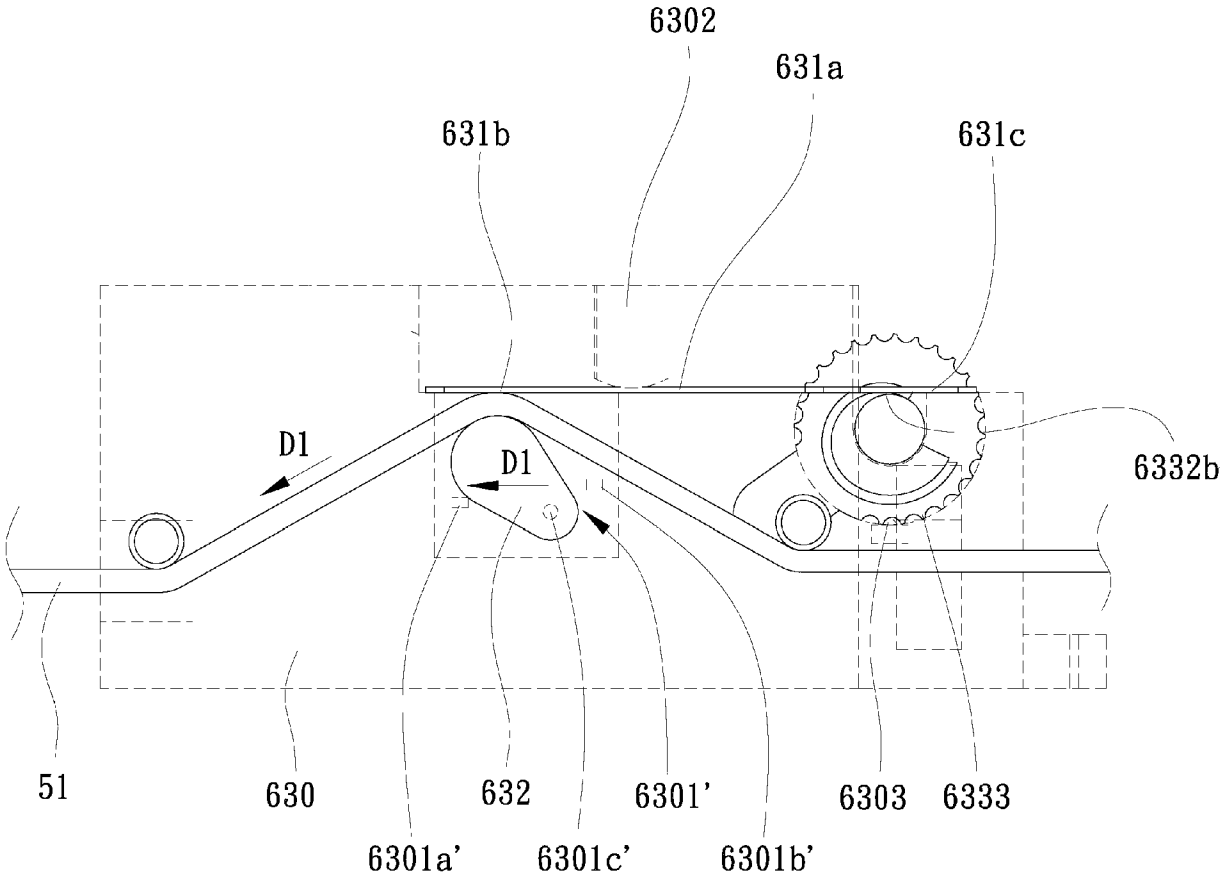
FIG. 24 shows an alternative implementation of the channel of FIG. 21.
Figure 25:
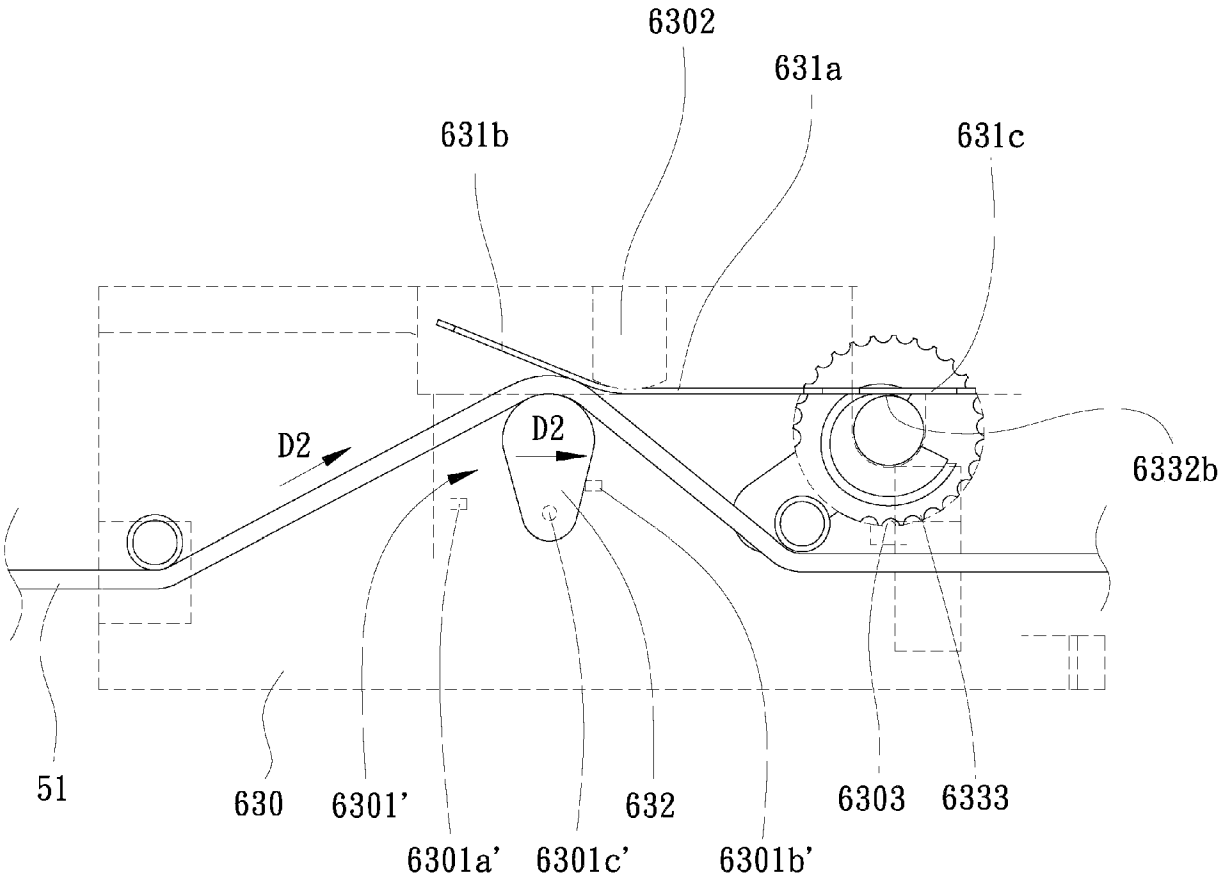
FIG. 25 shows an alternative implementation of the channel of FIG. 22.

It is worth mentioning that, the channel 6301 of the base 630 is not limited to be a passage with continuous supporting walls; in other words, the first restriction portion 6301*a*, the second restriction portion 6301*b*, and the supporting portion 6301*c* are not necessary to be connected. The channel 6301 would only need to have necessary supportive points (e.g., multiple separated and non-continuous supporting surfaces or blocks) to restrict the moving path of the moving member 632, which would also serve the same function. For example, a channel 6301' of another implementation is shown in FIG. 24 and FIG. 25. The channel 6301' is a space surrounded by a first restriction portion 6301*a*', a second restriction portion 6301*b*', and a supporting portion 6301*c*', all separately provided. In the current example, the supporting portion 6301*c*' is a pivot shaft, and the moving member 632 could swing around the pivot shaft. The first restriction portion 6301*a*' and the second restriction portion 6301*b*' are blocks provided on two sides of the pivot shaft, and are used to restrict a space allowing the moving member 632 to swing from side to side. Understandably, the supporting portion could also be an L-shaped, V-shaped, U-shaped, or other shaped holder which can be used to support an end portion of the moving member 632, and said holder could be formed by continuous or non-continuous walls; either way is not a limitation of the present invention. As shown in FIG. 24, when the lifting cord 51 that passes through the resistance device 63 is moving in the first direction D1, it could drive the moving member 632 to move in the channel 6301' along with the lifting cord 51 in the first direction D1, which means the moving member 632 could swing left around a pivot center (i.e., the supporting portion 6301*c*') to touch the first restriction portion 6301*a*'. At this time, a top end of the moving member 632 would slightly press the first free end 631*b* of the friction member 63, forcing the first free end 631*b* to have a first elastic deformation amount, and therefore the lifting cord 51 would encounter a first resistance during its movement. As shown in FIG. 25, when the lifting cord 51 that passes through the resistance device 63 is moving in the second direction D2, it would drive the moving member 632 to move in the channel 6301' along with the lifting cord 51 in the second direction D2, which means the moving member 632 would swing right around the pivot center (i.e., the supporting portion 6301*c*') to touch the second restriction portion 6301*b*'. At this time, the top end of the moving member 632 would further greatly press the first free end 631*b* of the friction member 631, so that the first free end 631*b* would have a second elastic deformation amount relative to the main portion 631*a*, wherein the second elastic deformation amount is greater than the above-mentioned first elastic deformation amount. Therefore, the lifting cord 51 clamped between the friction member 631 and the moving member 632 would encounter a second resistance greater than the first resistance mentioned above.

Figure 23:
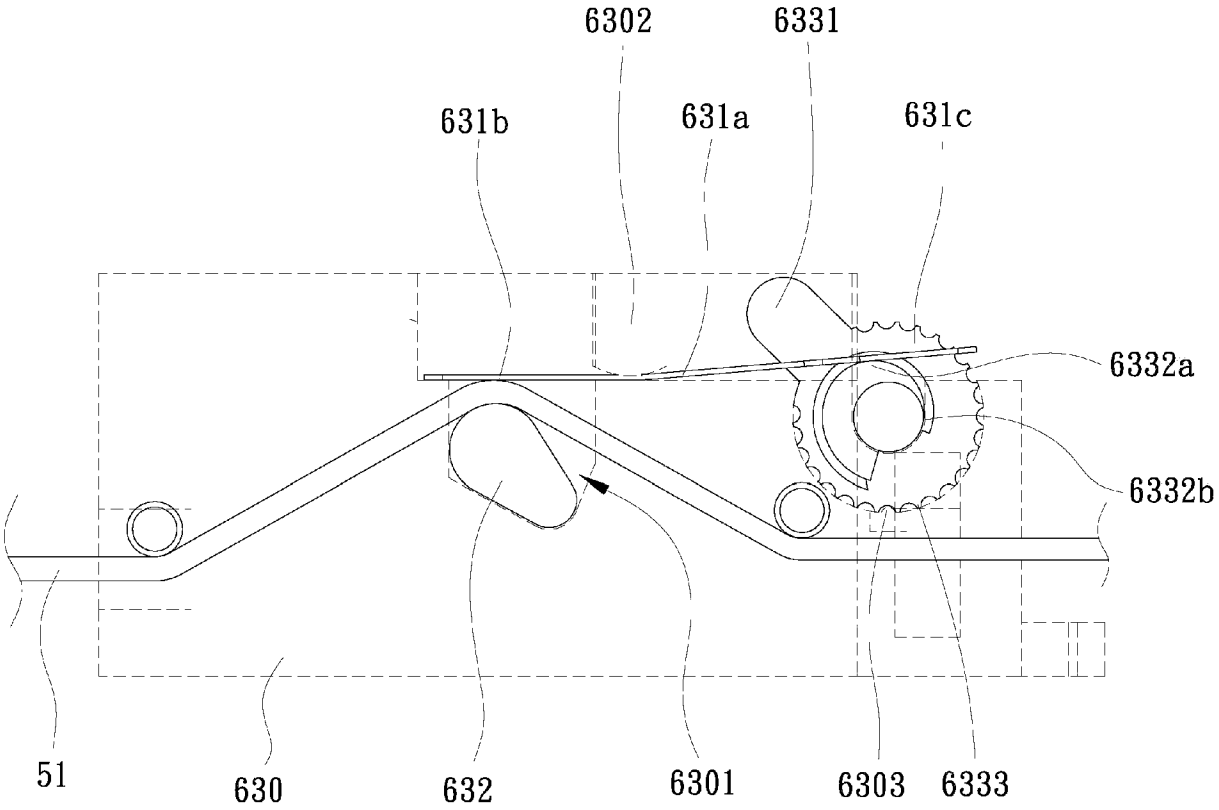
FIG. 23 is a schematic view showing that the adjusting member of the resistance device of FIG. 21 is located at another position.

The function of the adjusting member 633 will be described in the following paragraph, while FIG. 21 and FIG. 23 are used as references. The adjusting member 633 has roughly the same structure and operation as the adjusting member 623 of the second embodiment mentioned above. Similarly, the adjusting member 633 also uses the difference in the height of the outline of the cam-like actuating end 6332 to adjust the prestress exerted on the lifting cord 51 by the friction member 631. When in the condition shown in FIG. 21, the second free end 631*c* of the friction member 631 contacts the low point 6332*b* of the actuating end 6332 (i.e., the cam), the friction member 631 provides a prestress to the lifting cord 51, which is defined as the first prestress herein. When the operating end 6331 of the adjusting member 633 is rotated by an external force, the second engaging portion 6333 and the actuating end 6332 would be rotated synchronously. After being rotated, the toothed ring of the second engaging portion 6333 would allow the first engaging portion 6303 of the base 630 to fit into another recess thereof, so that the actuating end 6332 and the second free end 631*c* of the friction member 631 no longer press against each other at the low point 6332*b* of the cam, but the high point 6332*a* of the cam instead, as shown in FIG. 23. Correspondingly, since the object that the second free end 631*c* contacts has become the high point 6332*a* from the low point 6332*b*, the second free end 631*c* would therefore bend upward relative to the main portion 631*a* which abuts against the support 6302, which would cause the first free end 631*b* opposite to the second free end 631*c* to bend downward. However, since the first free end 631*b* presses against the lifting cord 51 and is supported by the moving member 632, the space for its downward bending is limited. As a result, the prestress exerted to the lifting cord 51 by the friction member 631 would increase, and the increased prestress is defined as the second prestress herein. Similar to the aforementioned second embodiment, the rotation angles of the adjusting member 633 could correspond to multiple steps in adjustment, so that the prestress provided to the friction member 631 could be adjusted in multiple steps. In this way, the lifting cord 51 passing through the resistance device 63 would not only be limited to encounter the first resistance and the second resistance, but could also encounter resistance of different magnitudes. Therefore, the resistance device provided in the present invention could be applied in window coverings of different sizes and types.

It must be pointed out again that the embodiments described above are only some preferred embodiments of the present invention. All equivalent structures which employ the concepts disclosed in this specification and the appended claims should fall within the scope of the present invention.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A resistance device for a window covering, which comprises a covering material and a lifting mechanism, wherein the lifting mechanism comprises a lifting cord, and the lifting cord is linked to the covering material in a manner that the lifting cord is concurrently movable with the covering material; when the covering material is being retracted, the lifting cord moves in a first direction; when the covering material is being extended, the lifting cord moves in a second direction opposite to the first direction; the resistance device comprising:

a base having a channel therein;

a friction member provided in the base and having a spring sheet structure; and a moving member adjacent to the friction member, wherein the moving member is located in the channel, and is movable therein;

wherein, the resistance device is adapted to allow the lifting cord to pass through; the moving member is adapted to be driven by the lifting cord to move in same directions as the lifting cord; when the lifting cord moves in the first direction, the moving member moves inside the channel in the first direction as being driven by the lifting cord, and the friction member provides a first resistance to the lifting cord; when the lifting cord moves in the second direction, the moving member moves inside the channel in the second direction as being driven by the lifting cord, and the friction member provides a second resistance to the lifting cord; wherein the first resistance is different from the second resistance; wherein the moving member remains in contact with the lifting cord when the lifting cord moves in one of the first direction and the second direction and after the lifting cord moves in the one of the first direction and the second direction.

2. The resistance device of claim 1, wherein the channel is a passage with continuous supporting walls; in a circumstance that the resistance device is applied in the window covering, when the lifting cord moves in the first direction, the lifting cord drives the moving member to move in the first direction along the passage; when the lifting cord moves in the second direction, the lifting cord drives the moving member to move in the second direction along the passage.

3. The resistance device of claim 1, wherein the channel has a first restriction portion and a second restriction portion; when the lifting cord moves in the first direction, the lifting cord drives the moving member to move to a position where the moving member touches the first restriction portion; when the lifting cord moves in the second direction, the lifting cord drives the moving member to move to another position where the moving member touches the second restriction portion.

4. The resistance device of claim 1, wherein the channel comprises at least one supporting portion; the moving member is supported by the at least one supporting portion and therefore is movable in the channel.

5. The resistance device of claim 1, wherein the second resistance is greater than the first resistance.

6. The resistance device of claim 5, wherein the friction member has a main portion and a first free end extending from a side of the main portion; the main portion is supported by the base, so that the first free end has an elastic deformation relative to the main portion when applied with force.

7. The resistance device of claim 6, wherein, in a circumstance that the resistance device is applied in the window covering, the first free end pushes against the lifting cord so that the lifting cord is clamped between the friction member and the moving member.

8. The resistance device of claim 6, wherein, in a circumstance that the resistance device is applied in the window covering, the first free end pushes against the moving member, and the lifting cord passes through and gets clamped in the moving member.

9. The resistance device of claim 6, wherein, in a circumstance that the resistance device is applied in the window covering, when the lifting cord moves in the first direction, the lifting cord drives the moving member to press the first free end of the friction member, which causes the first free end of the friction member to have a first elastic deformation amount relative to the main portion; when the lifting cord moves in the second direction, the lifting cord drives the moving member to press the first free end of the friction member, which causes the first free end of the friction member to have a second elastic deformation amount relative to the main portion; the second elastic deformation amount is greater than the first elastic deformation amount.

10. The resistance device of claim 9, wherein the channel has a first end and a second end; a width of the first end is greater than a width of the second end; when the lifting cord moves in the first direction, the lifting cord drives the moving member to move to the first end; when the lifting cord moves in the second direction, the lifting cord drives the moving member to move to the second end.

11. The resistance device of claim 1, wherein the resistance device further comprises an adjusting member which mutually contacts the friction member; the adjusting member is adapted to adjust a prestress exerted to the lifting cord by the friction member.

12. The resistance device of claim 11, wherein the friction member has a main portion, a first free end, and a second free end; the first free end extends outward from a side of the main portion, and the second free end extends outward from another side of the main portion opposite to the side for the first free end; the main portion is supported by the base; the first free end is adapted to provide the prestress to the lifting cord, and the second free end contacts the adjusting member.

13. The resistance device of claim 12, wherein the adjusting member further has an operating end and an actuating end; the actuating end contacts the second free end; the operating end is exposed out of the base, and is adapted to be operated by an external force to drive the actuating end to change a position of the second free end.

14. The resistance device of claim 13, wherein the actuating end has a low point and a high point; when the operating end is operated by the external force to make the low point of the actuating end contact the second free end, the prestress provided by the friction member to the lifting cord is a first prestress; when the operating end is operated by the external force to make the high point of the actuating end contact the second free end, the prestress provided by the friction member to the lifting cord is a second prestress; wherein the first prestress is different from the second prestress.

15. The resistance device of claim 14, wherein the first prestress is less than the second prestress.

16. The resistance device of claim 13, wherein the base further has a first engaging portion, and the adjusting member further has a second engaging portion provided corresponding to the first engaging portion, wherein the first and the second engaging portions are provided to be engaged with each other; the operating end of the adjusting member is adapted to be operated by the external force to change a position of the second engaging portion relative to the first engaging portion, whereby to change a position where the actuating end contacts the second free end of the friction member, changing a position of the second free end.

17. The resistance device of claim 16, wherein one of the first engaging portion and the second engaging portion is a protrusion, while the other one is a toothed ring with multiple recesses; the operating end of the adjusting member is adapted to be operated by the external force, whereby to fit the protrusion into any one of the recesses of the toothed ring.

* * * * *